US010665441B2

(12) United States Patent
McAlister et al.

(10) Patent No.: US 10,665,441 B2
(45) Date of Patent: May 26, 2020

(54) METHODS AND APPARATUS FOR IMPROVED TANDEM MASS SPECTROMETRY DUTY CYCLE

(71) Applicant: Thermo Finnigan LLC, San Jose, CA (US)

(72) Inventors: Graeme McAlister, San Jose, CA (US); Chad R. Weisbrod, Tallahassee, FL (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 16/058,194

(22) Filed: Aug. 8, 2018

(65) Prior Publication Data

US 2020/0051800 A1 Feb. 13, 2020

(51) Int. Cl.
*H01J 49/10* (2006.01)
*H01J 49/42* (2006.01)
(Continued)

(52) U.S. Cl.
CPC ..... *H01J 49/0072* (2013.01); *H01J 49/0031* (2013.01); *H01J 49/065* (2013.01);
(Continued)

(58) Field of Classification Search
CPC .. H01J 49/004; H01J 49/0031; H01J 49/0045; H01J 49/005; H01J 49/063;
(Continued)

(56) References Cited

U.S. PATENT DOCUMENTS 5,847,386 A * 12/1998 Thomson ..... H01J 49/005 250/288
6,114,691 A * 9/2000 Cousins ..... H01J 49/427 250/282
(Continued)

FOREIGN PATENT DOCUMENTS

EP 1884980 B1 6/2011
EP 2277190 B1 9/2011
(Continued)

OTHER PUBLICATIONS

Egertson et al., "Multiplexed peptide analysis using data-independent acquisition and Skyline", Nature Protocols. 2015, 10, 887-903.
(Continued)

*Primary Examiner* — David A Vanore
(74) *Attorney, Agent, or Firm* — Thomas F. Cooney

(57) ABSTRACT

A method for parallel accumulation and serial fragmentation of ions, wherein ions are injected into a device capable of serial ejection using a pseudopotential barrier created by an RF voltage. In all instances, the ions may be filtered prior to accumulation in the device capable of serial ejection. In some cases this filtering may take the form of discrete isolation windows using isolation waveforms with multiple notches. In some cases these waveforms may be applied to a quadrupole mass filter. Following accumulation of the precursor ions, the initial population may be serially ejected using a pseudopotential barrier created by an RF voltage. Following serial ejection, the individual precursor ion populations are analyzed. In some cases, this analysis might involve additional rounds of ion isolation and manipulation (e.g., MSn, CID, ETD, etc.).

21 Claims, 10 Drawing Sheets

(51) Int. Cl.
*H01J 49/00* (2006.01)
*H01J 49/06* (2006.01)

(52) U.S. Cl.
CPC ..... *H01J 49/421* (2013.01); *H01J 49/4225* (2013.01); *H01J 49/10* (2013.01)

(58) Field of Classification Search
CPC .... H01J 49/427; H01J 49/4295; H01J 49/061; H01J 49/065; H01J 49/4265; H01J 49/0027; H01J 49/10; H01J 49/26; H01J 49/421; H01J 49/4255; H01J 49/426
USPC ..... 250/281, 282, 288, 290, 293, 299
See application file for complete search history.

(56) References Cited

U.S. PATENT DOCUMENTS 6,177,668 B1* 1/2001 Hager ..... H01J 49/004 250/281
6,483,109 B1 11/2002 Reinhold et al.
6,504,148 B1* 1/2003 Hager ..... H01J 49/004 250/281
6,534,764 B1* 3/2003 Verentchikov ..... H01J 49/004 250/282
6,630,662 B1* 10/2003 Loboda ..... G01N 27/622 250/281
6,703,607 B2 3/2004 Stott
6,794,641 B2 9/2004 Bateman
6,815,673 B2* 11/2004 Plomley ..... H01J 49/004 250/281
6,833,544 B1* 12/2004 Campbell ..... H01J 49/4225 250/281
7,067,802 B1* 6/2006 Kovtoun ..... H01J 49/063 250/281
7,446,310 B2* 11/2008 Kovtoun ..... H01J 49/004 250/281
7,456,396 B2* 11/2008 Quarmby ..... H01J 49/427 250/282
7,633,060 B2* 12/2009 Kovtoun ..... H01J 49/427 250/282
7,829,851 B2* 11/2010 McLuckey ..... H01J 49/4225 250/282
10,128,099 B1* 11/2018 Schwartz ..... H01J 49/4255
10,290,482 B1* 5/2019 Yamada ..... H01J 49/005
2002/0121597 A1* 9/2002 Tanner ..... H01J 49/421 250/288
2003/0189171 A1* 10/2003 Londry ..... H01J 49/0063 250/292
2004/0245452 A1* 12/2004 Bateman ..... G01N 27/622 250/287
2005/0253064 A1 11/2005 Loboda
2006/0113464 A1* 6/2006 Litherland ..... B01D 59/44 250/288
2007/0034810 A1* 2/2007 Hoyes ..... H01J 49/427 250/396 R
2007/0084998 A1 4/2007 Franzen et al.
2009/0194683 A1* 8/2009 Guna ..... H01J 49/0063 250/282
2009/0194684 A1* 8/2009 Guna ..... H01J 49/426 250/282
2010/0019143 A1* 1/2010 Dobson ..... H01J 49/0013 250/283
2010/0108880 A1* 5/2010 Stoermer ..... H01J 49/0072 250/283
2010/0176291 A1* 7/2010 Hager ..... H01J 49/004 250/283
2010/0294923 A1* 11/2010 Kenny ..... H01J 49/0045 250/282
2011/0049346 A1* 3/2011 Wells ..... H01J 49/04 250/282
2011/0204218 A1* 8/2011 Hager ..... H01J 49/0031 250/282
2011/0284741 A1* 11/2011 Stoermer ..... H01J 49/0072 250/292
2012/0032074 A1* 2/2012 Kenny ..... H01J 49/0031 250/283
2012/0091330 A1* 4/2012 Coon ..... H01J 49/004 250/282
2012/0261568 A1* 10/2012 Coon ..... H01J 49/0027 250/282
2013/0105681 A1* 5/2013 Kovtoun ..... H01J 49/0481 250/282
2013/0284917 A1* 10/2013 Badiei ..... H01J 49/005 250/288
2014/0264008 A1 9/2014 Hoyes
2014/0306106 A1* 10/2014 Olney ..... H01J 49/0009 250/282
2014/0339421 A1 11/2014 Senko
2015/0179419 A1* 6/2015 Silivra ..... H01J 49/0031 250/282
2015/0340213 A1* 11/2015 Belov ..... H01J 49/009 250/282
2015/0364309 A1* 12/2015 Welkie ..... H01J 49/062 250/282
2016/0126076 A1* 5/2016 Baba ..... H01J 49/063 250/489
2016/0247671 A1* 8/2016 Collings ..... H01J 49/428
2017/0162372 A1 6/2017 Stephenson, Jr. et al.
2017/0345632 A1* 11/2017 McAlister ..... H01J 49/4215
2017/0345636 A1* 11/2017 Kovtoun ..... H01J 49/423
2018/0190481 A1* 7/2018 Zabrouskov ..... H01J 49/0059
2018/0323050 A1* 11/2018 Smith ..... H01J 49/0031
2018/0350578 A1* 12/2018 Yip ..... H01J 49/0031

FOREIGN PATENT DOCUMENTS

EP 1943663 B1 1/2018
EP 3179501 B1 10/2018

OTHER PUBLICATIONS

Erickson et al., "Evaluating Multiplexed Quantitative Phosphopeptide Analysis on a Hybrid Quadrupole Mass Filter/Linear Ion Trap/Orbitrap Mass Spectrometer", Analytical Chemistry 87(2), 2015 pp. 1241-1249.
Gerlich, "Inhomogenous RF Fields: A Versatile Tool for the Study of Processes with Slow Ions", State-selected and State-to-State Ion-Molecule Reaction Dynamics. Part 1: Experiment, Advances in Chemical Physics Series, vol. LXXXII, John Wiley & Sons, Inc. ,1992, 1-177.
Gillet, et al., "Targeted Data Extraction of the MS/MS Spectra Generated by Data-independent Acquisition: A New Concept for Consistent and Accurate Proteome Analysis", Molecular & Cellular Proteomics 11.6, 2012, pp. 1-17.
Hebert et al., "The one hour yeast proteome", Molecular and Cellular Proteomics 2014, 3, 339-347.
Ibrahim et al., "Improving Mass Spectrometer Sensitivity Using a High-Pressure Electrodynamic Ion Funnel Interface", J Am Soc Mass Spectrom 2006, 17, pp. 1299-1305.
Kaiser, et al., "Controlled Ion Ejection from an External Trap for Extended m/z Range in FT-ICR Mass Spectrometry," Journal of the American Society for Mass Spectrometry, vol. 25, Issue 6, 2014, pp. 943-949.
Meier et al., "Parallel Accumulation—Serial Fragmentation (PASEF): Multiplying Sequencing Speed and Sensitivity by Synchronized Scans in a Trapped Ion Mobility Device", Journal of Proteome Research 2015, 12, 5378-5387.
Saba et al., "Increasing the Productivity of Glycopeptides Analysis by Using Higher-Energy Collision Dissociation-Accurate Mass-Product-Dependent Electron Transfer Dissociation", International Journal of Proteomics 2012, 1-7.
Scheltema et al., "The Q Exactive HF, a Benchtop Mass Spectrometer with a Pre-filter, High-performance Quadrupole and an Ultra-high-field Orbitrap Analyzer", Molecular and Cellular Proteomics 2014, 12, 3698-3708.

(56) References Cited

OTHER PUBLICATIONS

Song et al,, "Demonstration of using Isolation Waveforms for Beam Type Selected-Reaction-Monitoring on a QqLIT Mass Spectrometer", Poster, 64th Conference of the American Society for Mass Spectrometry, 2016.
Dobson et al. , "Influence on mass-selective ion ejection of the phas difference the drive r.f. and the axial modulation potentials", J. Mass Spectrom., 2005, 40, pp. 714-721.
Kenny et al., "Scanwave: A New Approach to Enhancing Spectral Data on a Tandem Quadrupole Mass Spectrometer", J Am Soc Mass Spectrom 2010, 21, pp. 1061-1069.
March, R. E. (2012), "Quadrupole Ion Trap Mass Spectrometer", Update based on the original article by Raymond March, Encyclopedia of Analytical Chemistry, © 2000, John Wiley & Sons, Ltd., In Encyclopedia of Analytical Chemistry (eds R. A. Meyers and R. A. Meyers). doi:10.1002/9780470027318.a6015.pub2.

* cited by examiner

METHODS AND APPARATUS FOR IMPROVED TANDEM MASS SPECTROMETRY DUTY CYCLE

FIELD OF THE INVENTION

This invention relates generally to mass spectrometry and mass spectrometers and, more particularly, to methods and apparatus for any of ion fragmentation, ion reaction or tandem mass spectrometry, including multistage tandem mass spectrometry.

BACKGROUND OF THE INVENTION

Modern mass spectrometers are capable of highly sophisticated ion manipulations. Tandem mass spectrometry, including multistage tandem mass spectrometry or $MS^n$, synchronous precursor selection, ion/ion reactions, and fast spectral acquisition rates are all part of the standard mass spectrometry toolbox. Due, in large part, to the development of these modern capabilities, mass spectrometer users are routinely performing experiments that would have been impossible only a few years prior to this writing. For example, the types of experiments that are now routinely performed include analyzing a yeast proteome in less than one hour, accurate relative quantitation across ten channels using synchronous precursor selection-based $MS^3$ analysis of Tandem Mass Tag (TMT) labeled samples, and previously-unachievable glycopeptide sequence coverage using electron transfer dissociation (see Hebert, A. S. et al. The one hour yeast proteome. *Molecular and Cellular. Proteomics* 2014, 3, 339-347; Erickson, B. K. et al. Evaluating multiplexed quantitative phosphopeptide analysis on a hybrid quadrupole mass filter/linear ion trap/orbitrap mass spectrometer. Analytical Chemistry 2015, 2, 1241-1249; Saba, J. et al. Increasing the Productivity of Glycopeptides Analysis by Using Higher-Energy Collision Dissociation-Accurate Mass-Product-Dependent Electron Transfer Dissociation. *International Journal of Proteomics* 2012). In the above, and in the remainder of this document, the symbolism $MS^n$, or related symbolism in which "n" is replaced by a specific number, refers to multistage tandem mass spectrometry. In this document, the term "tandem mass spectrometry" is used in a broad sense to include such multistage techniques, in addition to traditional MS/MS (i.e., $MS^2$) mass spectrometry. During an $MS^2$ mass spectrometer analysis, a precursor is isolated and then fragmented to yield a first generation of product ions. During high order $MS^n$ experiments, in which n is greater than 2, after a first sequence of precursor ion isolation and fragmentation, to yield a first generation of fragment ions, one or more species of the first generation of fragment ions are further isolated and fragmented to form a second-generation of fragment ions, where this sequence of events (fragmentation of an earlier generation of fragment ions) may be reiterated any number of times.

FIG. 1A depicts the components of a general conventional mass spectrometer system 1 that may be employed for tandem mass spectrometry. An ion source, which may take the form of an electrospray ion source 5, generates ions from an analyte material supplied from a sample inlet. For example, the sample inlet may be an outlet end of a chromatographic column, such as liquid or gas chromatograph (not depicted), from which an eluate is supplied to the ion source. The ions are transported from ion source chamber 10 that, for an electrospray source, will typically be held at or near atmospheric pressure, through several intermediate-vacuum chambers 20, 25 and 30 of successively lower pressure, to a high-vacuum chamber 35. The high-vacuum chamber 35 houses a quadrupole mass filter (QMF) 51, an ion reaction cell 52 (such as, a collision cell, fragmentation cell, or ion routing multipole), and a mass analyzer 40. Efficient transport of ions from ion source 5 to the high-vacuum chamber 35 is facilitated by a number of ion optic components, including quadrupole radio-frequency (RF) ion guides 45 and 50, octopole RF ion guide 55, skimmer 60, and electrostatic lenses 65 and 70. Ions may be transported between the ion source chamber 10 and first intermediate-vacuum chamber 20 through an ion transfer tube 75 that is heated to evaporate residual solvent and break up solvent-analyte clusters. Intermediate-vacuum chambers 20, 25 and 30 and high-vacuum chamber 35 are evacuated by a suitable arrangement of pumps to maintain the pressures therein at the desired values. In one example, intermediate-vacuum chamber 20 communicates with a port of a mechanical pump (not depicted), and intermediate-vacuum chambers 25 and 30, and high-vacuum chamber 35, communicate with corresponding ports of a multistage, multiport turbomolecular pump (also not depicted).

Electrodes 80 and 85 (which may take the form of conventional plate lenses) positioned axially outward from the mass analyzer 40 may be used in the generation of a potential well for axial confinement of ions, and also to effect controlled gating of ions into the interior volume of the mass analyzer 40. The mass analyzer 40, which may comprise a quadrupole ion trap, a quadrupole mass filter, a time-of-flight analyzer, a magnetic sector mass analyzer, an electrostatic trap, or any other form of mass analyzer, is provided with at least one detector 49 that generates a signal or signals representative of the abundance of ions of each m/z. If the mass analyzer 40 is provided as a quadrupole mass filter, then a detector at the position shown in FIG. 1A will generally be employed so as to receive and detect those ions which selectively pass through the mass analyzer 40 from an entrance end to an exit end. If, alternatively, the mass analyzer 40 is provided as a linear electrodynamic ion trap or other form of mass analyzer, then one or more detectors at alternative detector positions may be employed. Various alternative analyzer methods and detector geometries are also envisaged.

Ions enter an inlet end of the mass analyzer 40 as a continuous or quasi-continuous beam after first passing, in the illustrated conventional apparatus, through a quadrupole mass filter (QMF) 51 and an ion reaction cell 52. The QMF 51 may take the form of a conventional multipole structure operable to selectively transmit ions within an m/z range determined by the applied RF and DC voltages. The reaction cell 52 may also be constructed as a conventional multipole structure to which an RF voltage is applied to provide radial confinement. The reaction cell may be employed, in conventional fashion, as a collision cell for fragmentation of ions. In such operation, the interior of the cell 52 is pressurized with a suitable collision gas, and the kinetic energies of ions entering the collision cell 52 may be regulated by adjusting the DC offset voltages applied to QMF 51, collision cell 52 and lenses 53 and 80.

The mass spectrometer system 1 shown in FIG. 1A may operate as a conventional triple quadrupole mass spectrometer, wherein ions are selectively transmitted by QMF 51, fragmented in the ion reaction cell 52 (employed as a collision cell), and wherein the resultant product ions are mass analyzed so as to generate a product-ion mass spectrum by mass analyzer 40 and detector 49. Samples may be analyzed using standard techniques employed in triple quadrupole mass spectrometry, such as precursor ion scanning, product ion scanning, single- or multiple reaction monitoring, and neutral loss monitoring, by applying (either in a fixed or temporally scanned manner) appropriately tuned RF and DC voltages to QMF 51 and mass analyzer 40. The operation of the various components of the mass spectrometer systems may be directed by a controller or a control and data system 15, which will typically consist of a combination of general-purpose and specialized processors, application-specific circuitry, and software and firmware instructions. The control and data system 15 may also provide data acquisition and post-acquisition data processing services. As is well known, the mass spectrometer system comprises one or more power supply units 41, 42, 43 to provide the appropriate RF and DC voltages for containing the ions with various multipole ion guides, ion filters and collision cells. The power supply units also provide the appropriate DC voltages and drag fields to the various lenses, ion guides, multipole rod electrodes and/or other ion optics components for the purpose of urging the ions along a general pathway from the ion source to the detector.

FIG. 1B is a schematic depiction of an exemplary mass spectrometer system 150 that may be employed for more complex mass spectrometry experiments and measurements, such as $MS^n$ experiments and measurements. The mass spectrometer illustrated in FIG. 1B is a hybrid mass spectrometer, comprising more than one type of mass analyzer. Specifically, the mass spectrometer system 150 includes a quadrupole ion trap mass analyzer 116 as well as an ORBITRAP™ analyzer 112, which is a type of electrostatic trap mass analyzer. Since, as will be described below, and in accordance with the present teachings, various analysis methods employ multiple mass analyzers, and as such, a hybrid mass spectrometer system can be advantageously employed to improve duty cycles by using two or more analyzers simultaneously. The ORBITRAP™ mass analyzer 112 employs image charge detection, in which ions are detected indirectly by the image current they induce on a set of outer electrodes of the analyzer by the motion of ions within an ion trap.

In operation of the mass spectrometer system 150, an electrospray ion source 101 provides ions of a sample to be analyzed to an aperture of a heated ion transfer tube 102, at which point the ions enter into a first vacuum chamber. After entry, the ions are captured and focused into a tight beam by a stacked-ring ion guide 104 or, alternatively, an ion funnel. A first ion optical transfer component 103*a* transfers the beam into downstream intermediate-vacuum regions of the mass spectrometer. Most remaining neutral molecules and undesirable ion clusters, such as solvated ions, are separated from the ion beam by a curved beam guide 106. Neutral molecules and ion clusters follow a straight-line path whereas the paths of ions of interest are bent around the ninety-degree turn of the curved beam guide, thereby producing the separation.

A quadrupole mass filter 108 of the mass spectrometer system 150 is used in its conventional sense as a tunable mass filter so as to pass ions only within a selected m/z range. A subsequent ion optical transfer component 103*b* delivers the filtered ions to a curved ion trap ("C-trap") component 110. The C-trap 110 is able to transfer ions along a pathway between the quadrupole mass filter 108 and the ion trap mass analyzer 116. The C-trap 110 also has the capability to temporarily collect and store a population of ions and then deliver the ions, as a pulse or packet, into the ORBITRAP™ mass analyzer 112. The transfer of packets of ions is controlled by the application of electrical potential differences between the C-trap 110 and a set of injection electrodes 111 disposed between the C-trap 110 and the ORBITRAP™ mass analyzer 112. The curvature of the C-trap is designed such that the population of ions is spatially focused so as to match the angular acceptance of an entrance aperture of the ORBITRAP™ mass analyzer 112.

Multipole ion guide 114 and optical transfer component 103*c* serve to guide ions between the C-trap 110 and the ion trap mass analyzer 116. The multipole ion guide 114 provides temporary ion storage capability such that ions produced in a first processing step of an analysis method can be later retrieved for processing in a subsequent step. The multipole ion guide 114 can also serve as a fragmentation cell and ion trap, which, in the illustrated apparatus (FIG. 1B), is often referred to as an "ion routing multipole". Various ion optics along the pathway between the C-trap 110 and the ion trap mass analyzer 116 are controllable such that ions may be transferred in either direction, depending upon the sequence of ion processing steps required in a particular analysis method.

The ion trap mass analyzer 116 is a dual-pressure linear ion trap (i.e., a two-dimensional trap) comprising a high-pressure linear trap cell 117*a* and a low-pressure linear trap cell 117*b*, the two cells being positioned adjacent to one another and separated by a plate lens having a small aperture that permits ion transfer between the two cells and that also acts as a pumping restriction that allows different pressures to be maintained in the two traps. The environment of the high-pressure cell 117*a* favors ion trapping, ion cooling, ion fragmentation by either collision-induced dissociation or pulsed-q dissociation, ion/ion reactions by either electron transfer dissociation or proton-transfer reactions, and some types of photon activation, such as ultraviolet photo dissociation (UVPD). The environment of the low-pressure cell 117*b* favors analytical scanning with high resolving power and mass accuracy. The low-pressure cell includes a dual-dynode ion detector 115.

The use of either electron transfer dissociation or a proton transfer reaction, within a mass analysis method, requires the capability of performing controlled ion-ion reactions within a mass spectrometer. Ion-ion reactions, in turn, require the capabilities of generating reagent ions, and of causing the reagent ions to mix with sample ions. The mass spectrometer system 150, as depicted in FIG. 1B, illustrates two alternative reagent-ion sources, a first reagent-ion source 199*a* disposed between the stacked-ring ion guide 104 and the curved beam guide 106 and a second (alternative) reagent-ion source 199*b* disposed at the opposite end of the instrument, adjacent to the low-pressure cell 117*b* of the linear ion trap mass analyzer 116. Generally, any particular system will only include one reagent ion source at most. Nonetheless, both reagent ion sources could be included so as to facilitate the capability of performing different types of ion-ion reaction within a single instrument. In other embodiments, a single reagent ion source may be capable of generating multiple distinct ion/ion reagents. Although the following discussion is directed to reagent ion sources for PTR, similar discussion may apply to ETD reagent ion sources or other alternative forms of ion/ion reactions.

A first possible reagent ion source 199*a*, may be located between the stacked ring ion guide 104 and the curved beam guide 106. As illustrated, the reagent ion source 199*a* comprises a glow discharge cell comprising a pair of electrodes (anode and cathode) that are exposed to a reagent gas conduit 198*a* that delivers the reagent gas from a reagent liquid (or solid) reservoir 197*a* having a heater that volatilizes the reagent compound. When a high voltage is applied across the electrodes, glow discharge is initiated, which ionizes the reagent molecules flowing between the electrodes. Reagent anions from the glow discharge source are introduced into the ion optics path ahead of the quadrupole mass filter 108 within which they may be m/z selected. The reagent ions may then be accumulated in the multipole ion guide 114, and subsequently transferred into the high-pressure cell 117*a* of the dual-pressure linear ion trap 116 within which they are made available for the ion-ion reaction. The reaction products may be directly transferred to the low-pressure cell 117*b* or to the ORBITRAP™ mass analyzer 112 for m/z analysis.

A possible alternative reagent ion source 199*b* may be located adjacent to the low-pressure linear trap cell 117*b*, where it may comprise an additional high-vacuum chamber 192, from which reagent ions may be directed into the high-pressure cell 117*a* through an aperture in between chamber 192 and the high-pressure cell. In operation, gaseous reagent compound is supplied from a reagent liquid (or solid) reservoir 197*b* having a heater that volatilizes the reagent compound and is directed through a reagent gas conduit 198*b* that delivers the reagent gas into a partially confined ion generation volume 196. In operation, thermionic electrons supplied from an electrically heated filament 194 are directed into the ion generation volume 196 with a certain pre-determined energy by application of an electrical potential between the filament 194 and an accelerator electrode (not shown). The supplied energetic electrons cause ionization of the reagent gas so as to generate reagent ions. The reagent ions may then be guided into the high-pressure cell 117*a* by ion optical transfer component 103*d* under the operation of gate electrodes (not shown).

FIG. 2 is a more-detailed depiction of a general multipole device 352 which may be employed as an ion guide or as an ion storage device. The multipole device 352 includes an entrance electrode 353*a* (e.g., an entrance lens) disposed at an entrance end 358*a* of the device and an exit electrode 353*b* (e.g., an exit lens) disposed at an exit end 358*b*. The multipole device 352 may comprise four elongated, and substantially parallel, rod electrodes arranged as a pair of first rod electrodes 361 and a pair of second rod electrodes 362. The leftmost diagram of FIG. 2 provides a longitudinal view and the adjacent right-hand diagram provides a transverse cross-sectional view, of the ion storage device 352. Note that only one of the rod electrodes 362 is shown in the left-hand depiction, since the view of the second rod electrode 362 is blocked in the depicted view. The four rod electrodes define an axis 59 of the device that is parallel to the rod electrodes 362, 361 and that is centrally located between the rod electrodes; in other words, the four rod electrodes 362, 361 are equidistantly radially disposed about the axis 59. The rod electrodes are maintained in the proper configuration, relative to one another, by means of one or more support structures 357 made of an insulating material.

Although the ion storage device 352 shown in FIG. 2 is illustrated with straight, parallel rod electrodes, in some embodiments, the electrodes may be curved. Instead of being limited to just four rod electrodes so as to generate an RF electric field, the ion storage device may alternatively comprise six (6) rods, eight (8) rods, or even more rods so as to increase the contribution of higher-order electric fields (e.g., hexapolar and octopolar). For example, the cross-sectional view within inset 370 of FIG. 2 illustrates a configuration having a total of eight rods, organized as four rod pairs, specifically rod pairs 371, 372, 373 and 374, which together define a central axis 59. As is well known, during operation, each rod pair is energized with a different respective phase of an applied RF confining voltage.

One common complication with all of the tandem mass spectrometry, and general $MS^n$ methods (e.g., see Ibrahim, Y. et al. Improving the Sensitivity of Mass Spectrometer using a High-Pressure Electrodynamic Ion Funnel Interface. *Journal of the American Society of Mass Spectrometry* 2006, 9, 1299-1305; Scheltema, R. A. et al. The Q Exactive H F, a Benchtop Mass Spectrometer with a Pre-filter, High-performance Quadrupole and an Ultra-high-field Orbitrap Analyzer. *Molecular and Cellular Proteomics*□2014, 12, 3698-3708), is that successful analysis requires a large quantity of initial precursor ions so as to produce product ion mass spectra having sufficiently strong product-ion signals. For example, the experimental types described above often require more than one hundred thousand precursor ions for good results. Previous efforts to satiate these ion requirements have focused on increasing the permissiveness of the ion pathway (e.g., ion funnels and high-capacity transfer tubes), and a tendency towards analyzing larger amounts of sample (e.g., loading more sample and increasing the chromatography peak capacity). Unfortunately there are physical limitations to these approaches. For example, modern designs of ionization sources are rapidly approaching the theoretical ionization efficiency limit.

As an alternative to increasing the brightness of the ion beam or increasing ion transmission throughput, mass spectrometry sensitivity can be improved by utilizing a larger portion of the ion population generated at the ion source. In the field, this strategy is known as improving the instrument duty cycle. Most efforts to improve mass spectrometer duty cycle have focused on speeding up ion manipulations (e.g., fragmentation or ion-ion reaction) and analysis. In this disclosure, however, the inventors focus on another approach to improving instrument duty cycle during tandem mass spectrometry or higher-order $MS^n$ experiments. The novel approaches taught herein are based upon the concept of injecting and accumulating multiple precursor ions in parallel. In the novel approaches taught herein, the total analysis time spent injecting ions is reduced by accumulating multiple precursors in parallel, which results in shorter average spectral acquisition times and an improved overall duty cycle.

In some of the earliest implementations of this parallel ion accumulation method, all the accumulated precursor ions were manipulated and analyzed in parallel (e.g., see Gillet, L. C. et al. Targeted Data Extraction of the MS/MS Spectra Generated by Data-independent Acquisition: A New Concept for Consistent and Accurate Proteome Analysis. *Molecular and Cellular Proteomics*□2012, 6; Egertson, J. D. et al. Multiplexed peptide analysis using data-independent acquisition and Skyline. *Nature Protocols*. 2015, 10, 887-903). These methods are quite fast, because multiple precursor ions are processed in parallel during every MS step. However, these methods suffer from increased spectral complexity and limited dynamic range.

As an alternative, a recently implemented version of this method describes individual analysis of each of the parallel-accumulated precursor ion species. These parallel-accumulated precursor ions are sequentially ejected from an ion trap by trapped ion mobility (TIMS). Following TIMS-based ion ejection, the individual precursor ions are subjected to $MS^2$ analysis (Meier, F. et al. Parallel Accumulation-Serial Fragmentation (PASEF): Multiplying Sequencing Speed and Sensitivity by Synchronized Scans in a Trapped Ion Mobility Device. *Journal of Proteome Research* 2015, 12, 5378-5387). As implemented, there are two limitations to this earlier approach. Firstly, all the ions formed at the source are accumulated in parallel in the TIMS device. This step will limit the dynamic range of the method. Secondly, the ions accumulated in parallel are sequentially ejected based upon their mobility, which can be difficult to predict and, most often, must be experimentally measured. This fact limits the applicability of the Meier et al. method because it makes it difficult to apply the method to a sample comprised of previously uncharacterized molecules. Accordingly, there is the need in the art for improved methods of injecting and accumulating multiple precursor ions in parallel with subsequent sequential ion manipulation and analysis.

SUMMARY OF THE INVENTION

To address the above-identified needs in the art, the inventors herein propose an alternative to the parallel accumulation based methods described above. According to the present teachings, ions are injected into a device that is capable of serial ejection, where the serial ejection is effected using a pseudopotential barrier that is generated by an RF voltage. The ions formed at an ion source are filtered prior to accumulation in the device capable of serial ejection. Once the ions have finished accumulating, they are ejected in an m/z dependent order using an offset voltage that progressively overcomes, for each m/z window, a pseudopotential barrier that corresponds to the depth of a pseudopotential barrier. Following ejection, the ions in each serially ejected window are mass analyzed individually. In embodiments, this analysis may be performed in a quadrupole ion trap, an electrostatic trap, such as an ORBITRAP™ mass analyzer or a Cassini trap, or a time-of-flight mass analyzer. In various embodiments, the analysis of the ions within a window or within a plurality of windows might include additional rounds of ion isolation and manipulation (e.g., $MS^n$, fragmentation by collision-induced dissociation, electron capture dissociation, electron transfer dissociation, proton transfer reaction, etc.).

As noted above, many of the earlier methods that utilized parallel accumulation of multiple precursors have a limited dynamic range. As described herein, methods in accordance with the present teachings avoid this pitfall by filtering ions upstream of the pseudopotential-based ion accumulation and separation device. By including this filter, the instrument is not required to accumulate the entire breadth of ions formed at the source. As such, the instrument can accumulate more ions of interest before reaching the space-charge limit of the pseudopotential-based ion accumulation and separation device. In some cases, this up-stream filtering may take the form of discrete isolation windows using isolation waveforms with multiple notches. In some cases these waveforms may be applied to a quadrupole mass filter (e.g., Song, Q. et al. Demonstration of using Isolation Waveforms for Beam Type Selected-Reaction-Monitoring on a QqLIT Mass Spectrometer. *Proceedings of the* 64$^{th}$ *Conference of the American Society for Mass Spectrometry* 2016). After the precursor population is accumulated, the precursor ions are ejected in a serial order based upon their individual m/z ratios, as described above.

The other limitation that was discussed above relates to the use of ion mobility to sequentially eject ions that were accumulated in parallel. Ion ejection by mobility can be difficult to perform because most often ion mobilities must be experimentally measured and cannot be accurately predicted based upon the chemical formula or precursor m/z value. As an alternative, we propose sequentially ejecting ions using a pseudopotential barrier generated by an RF voltage.

According to a first aspect of the present teachings, a method for mass spectrometric analysis of ions of a plurality of ion species generated by ionization of a sample is provided, the method comprising: (a) isolating a plurality of portions of the ions, each portion consisting of a subset of the ion species within a respective range of mass-to-charge (m/z) values; (b) simultaneously retaining the isolated plurality of portions of the ions in an ion storage apparatus, wherein the retaining is at least partially facilitated by applying an auxiliary radio-frequency (RF) voltage waveform to a one of two electrode members of the ion storage apparatus, thereby generating a pseudopotential between the two electrode members, each electrode member either consisting of a single electrode or comprising a group of electrodes; (c) releasing the retained isolated portions of the ion species one at a time from the ion storage apparatus, the releasing comprising one or more of: varying a DC potential applied to a one of the electrode members, varying DC potentials applied to both of the electrode members, or by reducing an amplitude of the applied auxiliary RF voltage waveform; and (d) fragmenting or reacting each released portion of the ion species to thereby generate a respective set of product ion species and mass analyzing the product ion species.

In some embodiments, the step (a) may comprise generating each portion, one at a time, by passing a continuous beam of a plurality of ions that includes all of the ion species through a mass filter while operating the mass filter so as to eject all ion species other than ion species within the respective range of mass-to-charge (m/z) values corresponding to the portion, while the step (b) may comprise receiving and trapping each of the generated portions, one at a time, from the mass filter as they are generated. In some alternative embodiments, the step (a) may comprise generating the plurality of portions, simultaneously, by passing a continuous beam of a plurality of ions that includes all of the ion species through a mass filter while operating the mass filter so as to eject all ion species other than ion species within any one of the respective ranges of mass-to-charge (m/z) values corresponding to the plurality of portions while the step (b) may comprise receiving the plurality of portions simultaneously and trapping the plurality of portions as they are received. In some embodiments, the step (b) may comprise simultaneously retaining the isolated plurality of portions of the ions in a multipole apparatus comprising an entrance lens, an exit lens, and a set of parallel rod electrodes disposed between the entrance and exit lenses, the set of rod electrodes being the first electrode member and the exit lens being the second electrode member, wherein the auxiliary RF voltage waveform is applied to the exit lens. However, in some alternative embodiments, the auxiliary RF voltage waveform is instead applied to all of the rod electrodes, wherein the waveform applied to each rod electrode comprises a same phase, amplitude, and frequency as does a voltage waveform applied to each other rod electrode. In accordance with some still further alternative embodiments, the step (b) may comprise simultaneously retaining the isolated plurality of portions of the ions within a multipole apparatus comprising an entrance lens, an exit lens, and a sequence of sections defined along an axis of the ion storage apparatus, wherein a first subset of the plurality of portions of the ions is retained in a first section and a second subset of the plurality of portions of the ions is retained in a second section downstream from the first section, wherein a first one of the electrode members comprises electrodes of the first section and the other one of the electrode members comprises electrodes of the second section. Each section may comprise a respective plurality of rod electrode segments disposed about the axis of the ion storage device or, alternatively, a respective plurality of stacked plate electrodes, each plate electrode having an aperture and disposed such that the axis passes through the aperture.

According to some embodiments, a second plurality of portions of the ions may be isolated and retained in the ion storage apparatus simultaneously with the fragmenting or reacting and mass analyzing of an earlier plurality of portions of the ions. According to some embodiments, a second plurality of portions of the ions may be isolated and retained in the ion storage apparatus simultaneously with the releasing, from the ion storage apparatus, of an earlier plurality of portions of the ions.

According to a second aspect of the present teachings, a mass spectrometer system is provided, the mass spectrometer system comprising: (i) an ionization source; (ii) a mass filter apparatus configured to receive ions from the ionization source; (iii) a fragmentation or reaction cell configured to receive ions filtered according to mass-to-charge ratio (m/z) by the mass filter and to fragment or react the received ions so as to thereby generate product ions; (iv) a mass analyzer configured to receive, mass analyze and detect the product ions; (v) an ion guide having an axis and comprising (a) an entrance lens configured to receive the filtered ions from the mass filter; (b) an exit lens disposed downstream from the entrance lens and configured and to transmit the filtered ions to the fragmentation or reaction cell; and (c) a plurality of electrodes disposed between the entrance and exit lenses; and (vi) one or more power supplies electrically coupled to the ion guide, fragmentation or reaction cell and mass analyzer, wherein the one or more power supplies are configured to: supply an oscillatory radio-frequency (RF) voltage to the plurality of electrodes that confines ions within the ion guide to a vicinity of the axis; supply an auxiliary radio-frequency (RF) voltage waveform either to the exit lens or, with phase synchronicity, to all electrodes of the ion guide; and supply a variable DC potential difference between the plurality of electrodes and the exit lens.

According to some embodiments, the plurality of electrodes may comprise a set of mutually parallel rod electrodes that are parallel to and symmetrically disposed about an axis. According to some alternative embodiments, the plurality of electrodes may comprise a set of stacked plate electrodes, each plate electrode comprising an aperture, the plurality of apertures defining an ion channel through the ion guide between the entrance and exit lenses. In some embodiments, the mass spectrometer system may further comprise: (vii) an electronic controller or computer processor comprising machine-readable program instructions operable to cause the one or more power supplies to vary one or both of an amplitude of the auxiliary RF voltage waveform and the variable DC potential difference such that ions are prevented from exiting the ion guide. The electronic controller or computer processor may comprise further machine-readable instructions that are operable to cause the one or more power supplies to vary one or both of the amplitude of the auxiliary RF voltage waveform and the variable DC potential difference such that ion species are released from the ion guide in accordance with their respective m/z values. In some embodiments, the electronic controller or computer processor may comprise machine-readable instructions that are operable to cause the one or more power supplies to cause the fragmentation or reaction cell to either fragment or react each released ion species as it is received from the ion guide.

According to a third aspect of the present teachings, a mass spectrometer system is provided, the mass spectrometer system comprising: (i) an ionization source; (ii) a mass filter apparatus configured to receive ions from the ionization source; (iii) a fragmentation or reaction cell configured to receive ions filtered according to mass-to-charge ratio (m/z) by the mass filter and to trap and/or fragment or react the received ions so as to thereby generate product ions; (iv) a mass analyzer configured to receive, mass analyze and detect the product ions; (v) an ion guide configured to receive the filtered ions from the mass filter and to transmit the filtered ions to the fragmentation or reaction cell, the ion guide comprising: an entrance end and an ion exit end; an axis extending between the ion entrance and exit ends; and a sequence of sections disposed along the axis from the entrance lens to the exit lens; and (vi) one or more power supplies electrically coupled to the ion guide, the fragmentation or reaction cell, and the mass analyzer, the one or more power supplies configured to: supply a radio-frequency (RF) confining voltage to electrodes of all sections of the ion guide; supply an auxiliary RF voltage waveform to electrodes of a segment, each of a phase, amplitude and frequency of the provided auxiliary RF voltage being identical among all electrodes of the segment; and supply a DC potential difference between the segment to which the auxiliary RF voltage is provided and a second segment that is adjacent thereto.

In some embodiments, the electrodes of each section may comprise a stack of two or more plate electrodes, each plate electrode comprising an aperture, wherein the plurality of apertures of all plate electrodes define an ion channel through the ion guide. In alternative embodiments, each section may comprise a plurality of rod electrode segments that are symmetrically disposed about the axis.

BRIEF DESCRIPTION OF THE DRAWINGS

The above noted and various other aspects of the present invention will become apparent from the following description which is given by way of example only and with reference to the accompanying drawings, not drawn to scale, in which.

DETAILED DESCRIPTION

Figure 1A:
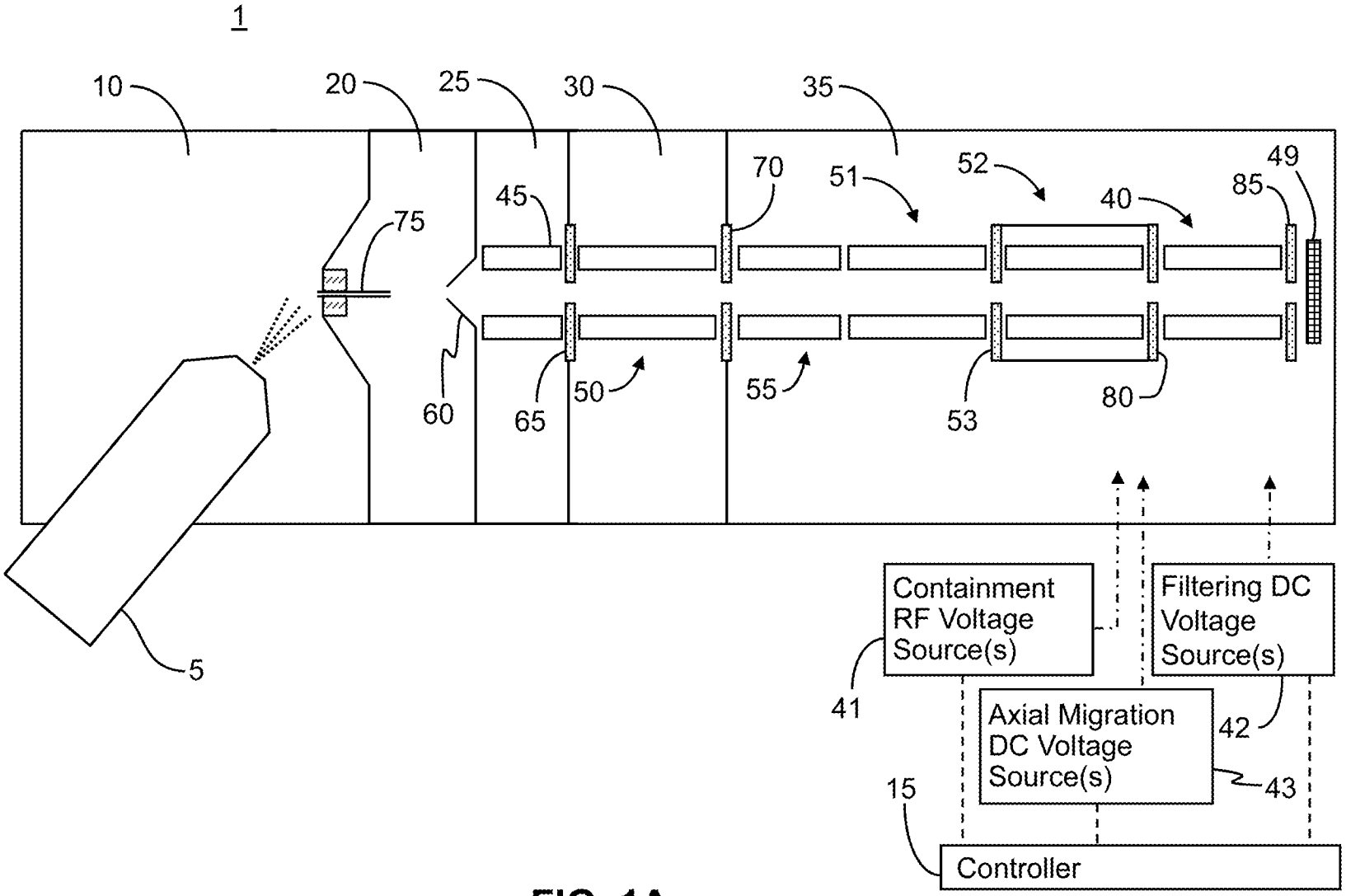
FIG. 1A (Prior Art)
FIG. 1A is a schematic diagram showing components of a conventional mass spectrometer system.
Figure 1B:
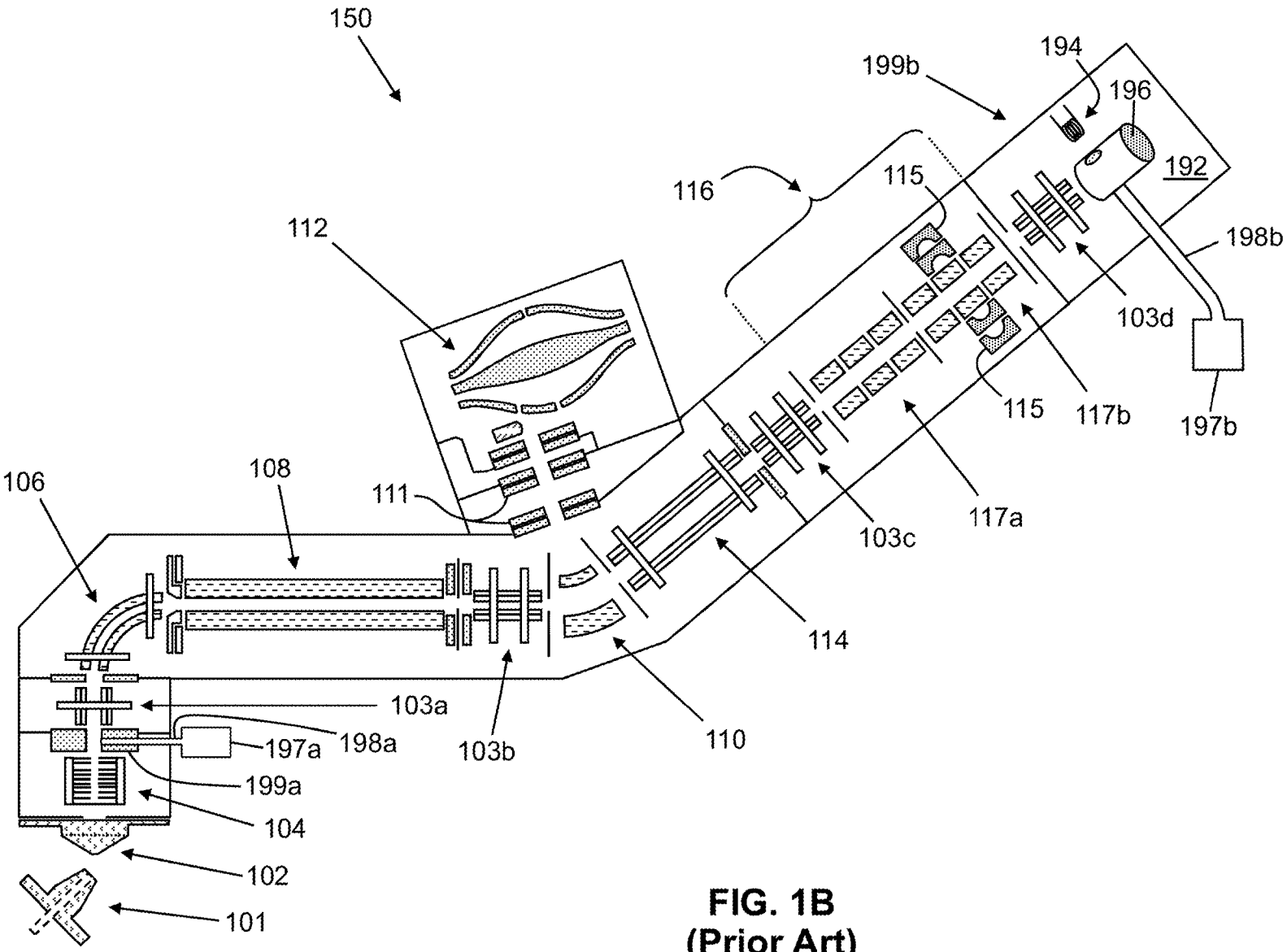
FIG. 1B (Prior Art)
FIG. 1B is a schematic diagram showing components of a hybrid mass spectrometer system.
Figure 2:
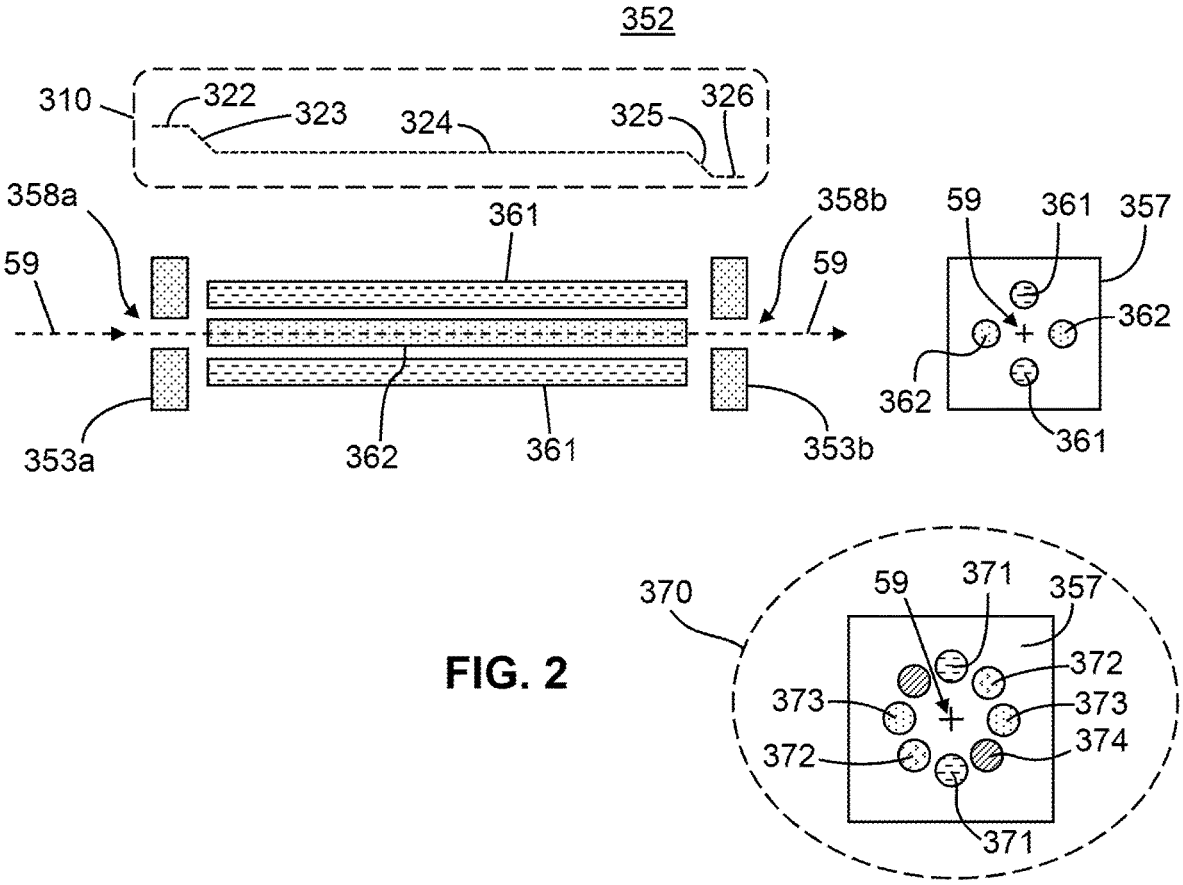
FIG. 2 is a schematic diagram of a conventional ion guide apparatus, showing both four and eight rod electrode configurations.

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described.

The particular features and advantages of the invention will become more apparent with reference to the appended FIGS. 2-8, taken in conjunction with the following description. Unless otherwise defined, all technical and scientific terms used herein have the meaning commonly understood by one of ordinary skill in the art to which this invention belongs. In case of conflict, the present specification, including definitions, will control. It will be appreciated that there is an implied "about" prior to the quantitative terms mentioned in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular. As used herein, and as commonly used in the art of mass spectrometry, the term "DC" does not specifically refer to or necessarily imply the flow of an electric current but, instead, refers to a non-oscillatory voltage which may be either constant or variable. Likewise, as used herein, and as commonly used in the art of mass spectrometry, the term "AC" does not specifically refer to or necessarily imply the existence of an alternating current but, instead, refers to an oscillatory voltage or oscillatory voltage waveform. The term "RF" refers to an oscillatory voltage or oscillatory voltage waveform for which the frequency of oscillation is in the radio-frequency range.

The reader should be aware that, throughout this document, the term "DC" is used in accordance with its general usage in the art so as to mean "non-oscillatory" without necessary implication of the existence of an associated electrical current. Thus, the usage of the terms "DC voltage", "DC voltage source", "DC power supply", "DC potential" etc. in this document are not, unless otherwise noted, intended to necessarily imply the generation or existence of an electrical current in response to the "DC voltage" or "DC potential" or to imply the provision of an electrical current by a "DC voltage source" or a "DC power supply". As used in the art, and as used herein, unless otherwise noted, the term "DC" is made in reference to electrical potentials (and not electrical current) so as to distinguish from radio-frequency (RF) potentials. A "DC" electrical potential, as commonly used in the art and as used herein, may be static but is not necessarily so; in other words, the DC potential could be variable. In this document, the terms "upstream" and "downstream" are used, in a relative sense, to convey a relative position of a component or entity along an ion pathway through various components from an ion source to an ion destination, where "upstream" represents components or positions along the pathway that are nearer to the ion source and "downstream" represents components or positions along the pathway that are nearer to the ion destination.

Pseudopotential-based ion ejection has been well studied, and is best summarized in the work by Gerlich (Gerlich, D. Inhomogenous RF Fields: A Versatile Tool for the Study of Processes with Slow Ions. *State-selected and State-to-State Ion-Molecule Reaction Dynamics. Part* 1. 1992, 1-177). Briefly, the application of an auxiliary, inhomogeneous RF field creates a pseudopotential barrier of the form:

$$U_{pseudopotential} = C\frac{U_{AC}^2}{\omega^2\left(\frac{m}{z}\right)} \quad \text{Eq. 1}$$

Where $U_{AC}$ and ω are the amplitude and angular frequency of the RF, m and z are the mass and charge of the ion of interest, and C is a geometry dependent parameter. The pseudopotential barrier may be offset or overcome by a DC potential, $U_{DC}$:

$$U_{DC} = C\frac{U_{AC}^2}{\omega^2\left(\frac{m}{z}\right)} = U_{pseudopotential} \quad \text{Eq. 2}$$

Note that the algebraic sign (positive or negative) of the m/z term in the denominator transfers to both the pseudopotential, $U_{pseudopotential}$, and the DC potential, $U_{DC}$, in either Eq. 1 or Eq. 2. For positively-charged ions, $U_{pseudopotential}$ and $U_{DC}$ are both positive; for negatively-charged ions, $U_{pseudopotential}$ and $U_{DC}$ are both negative. Regardless of the sign of z, in the absence of a DC potential that is able to overcome the pseudopotential barrier ions are motivated to migrate away from the region of space in which the ions oscillate in response to auxiliary field.

An ion will leave the pseudopotential-based ion separator when the "height" of the pseudopotential barrier (in the case of positively-charged ions) or "depth" of the barrier (in the case or negatively-charged ions) is just offset by the DC field created by the application of the DC potential. The rising portion of the pseudopotential barrier (in the case of positive ions) is sometimes loosely referred to as a "pseudopotential well" because of its resemblance to the rising pseudopotential barriers that maintain ion confinement within a restricted spatial region within a conventional RF ion trap, such as a Paul trap (three-dimensional trap) or a linear ion trap (two-dimensional trap). In the remainder of this document, it is assumed, for convenience, that ions are positively charged. Accordingly, ions are assumed to move down-potential and pseudopotentials are illustrated as "peaks" in the drawings. If negatively-charged ions are to be considered, then all potentials and pseudopotentials should be reversed in sign relative to those that are drawn and described herein.

Operationally, by application of an oscillatory RF voltage to at least one electrode of a pair of adjacent electrodes, it is possible to cause ions to physically oscillate about or around a region of space near or between the electrode or electrodes. In these areas of higher oscillation the ions will acquire more energy; as such, they will tend to move away from these higher energy regions towards lower energy regions. This bias or restriction of the ions to a particular region of space somewhat resembles the situation that would hypothetically occur if it were possible to create a static DC potential local maximum at the center of the region of oscillation. Since such a free-space electrostatic extremum is not possible, this fictitious potential that generates this real ion confinement is referred to as a pseudopotential.

When the multipole device 352 (FIG. 2) is employed as an ion guide, movement of ions in one direction along the axis 59 is facilitated by application of DC lens potentials to entrance and exit electrodes. Such DC potential offsets are schematically depicted in box 310 of FIG. 2, where the graph portions 322, 324 and 326 are a schematic depiction of the hypothetical variation of electrical potential along axis 59 of device 352. In box 310, as in elsewhere in this document, it is assumed that all ions are positively charged. However, as one of ordinary skill in the art will readily understand, the concepts described herein are not limited to positively charged ion species. The ion manipulations described herein are equally valid with regard to the manipulation of negatively charged species, provided that the algebraic signs of DC potentials are reversed. Graph portion 324 represents the DC electrical potential along the axis 59 where it is surrounded by the multipole rods and graph portions 322 and 324 represent DC potential applied to the entrance and exit electrodes (lenses) 353*a*, 353*b* that keep the ions moving in the direction of the arrows.

Conventionally, trapping of ions within the multipole device 352 may be achieved by raising the DC potential of the exit electrode 353*b* so that the DC potential(s) of both entrance and exit lenses are greater than the DC potential along axis 59 within the multipole. However, such conventional ion trapping does not discriminate among different m/z values. In order to release stored ions in order of their m/z values in accordance with methods of the present teachings, the inventors have recognized that a pseudopotential may be created between the multipole rods and one or both of the entrance and exit lenses by application of an auxiliary RF voltage.

Figure 3:
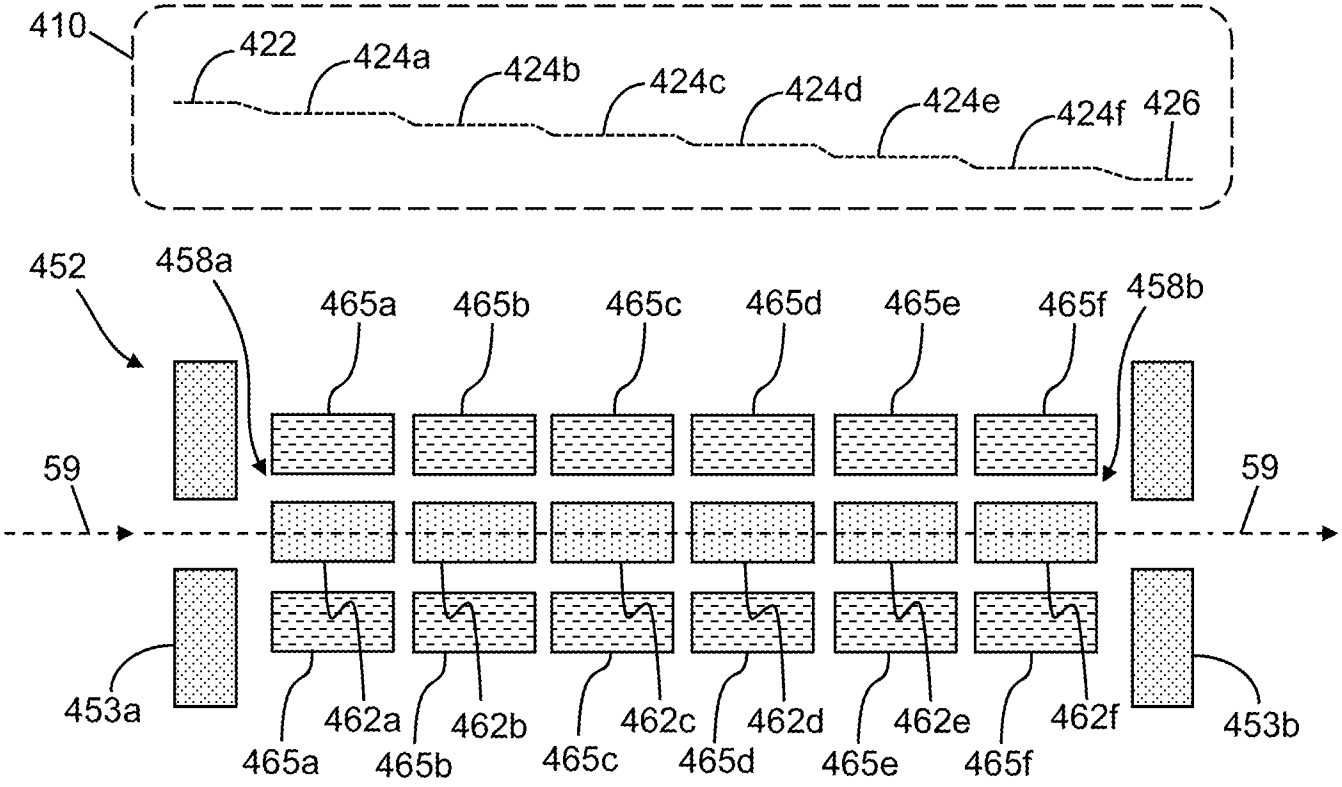
FIG. 3 (Prior Art)
FIG. 3 is a schematic illustration of an ion guide having segmented rods.

FIG. 3 illustrates a known ion storage apparatus 452 in which the rods 362 and the rods 361 (as shown in and previously described in reference to FIG. 2) are replaced by series of rod segments. Specifically, in the illustrative depiction of FIG. 3, each individual rod 361 of the apparatus 352 is replaced by six rod segments 461*a*-461*f* and each individual rod 362 of the apparatus 352 is replaced by the six rod segments 462*a*-462*f*. Each collection of four rod segments comprises a section of the apparatus 452. For example, six such sections, 465*a*-465*f*, are illustrated in FIG. 3 as well as in FIGS. 6A and 6B. Although each section (465*a*-465*f*) of the apparatus 452, as described and illustrated herein, is comprised of four rod segments, each such section could, alternatively, be configured as a general multipole device comprising a larger number of rod segments. In conventional operation, all of the segments 461*a*-461*f* are supplied with the same RF voltage and phase from a power supply via a set of isolating capacitors (not illustrated). Likewise, all of the segments 462*a*-462*f* are supplied with the same RF voltage that is phase-shifted relative the RF phase supplied to rod segments 461*a*-461*f*.

In conventional operation, variable DC voltages are applied to the different sections of the apparatus 452, such that each collection of four segments that make up a section is set at a particular respective DC voltage. As illustrated in box 410 of FIG. 3, the set of such applied voltages comprise a series of voltage steps 424*a*-424*f* that decrease in a direction from the entrance lens 453*a* to the exit lens 453*b*. The various voltage steps 424*a*-424*f* that are applied to the sections 465*a*-465*f*, and the voltages 422, 426 applied to the entrance and exit lenses, can create an internal field along the axis 59 and within the device 452 that assists in urging ions in the direction of the arrows within the device.

Figure 4:
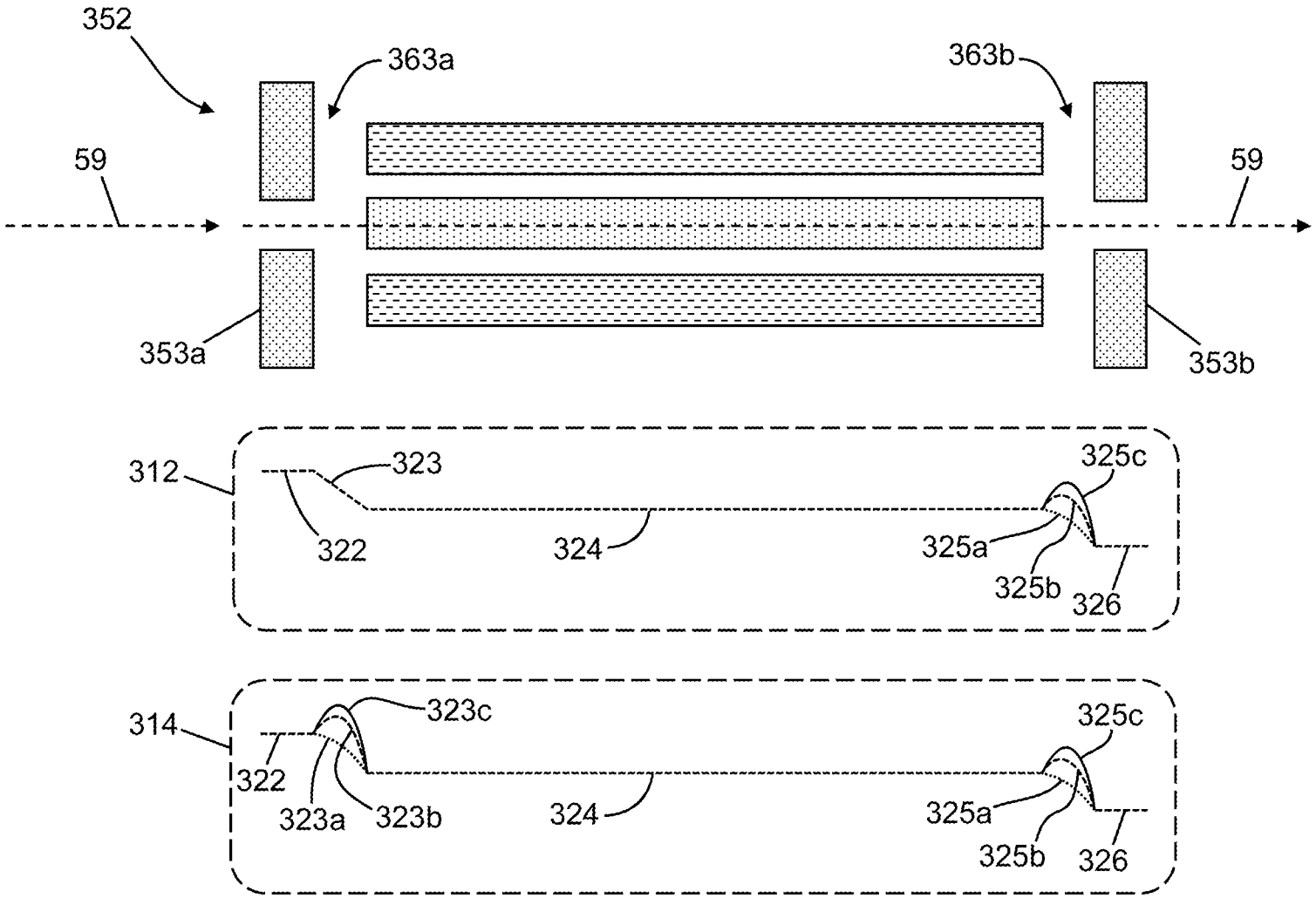
FIG. 4 is a schematic diagram of application of pseudopotentials and extraction potentials to the ion guide of FIG. 2 in accordance with the present teachings.

In accordance with some embodiments of the present teachings, the operation of the multipole device 352 (previously described with reference to FIG. 2) may be modified using pseudopotentials so that the device functions as an ion selector. For example, box 312 of FIG. 4 schematically illustrates the creation of pseudopotential barriers along the axis 59 between: (a) the multipole rods 361, 362 in the four rod multipole configuration, or, in the eight-rod configuration, between the rods 371, 372, 373, 374 and (b) the exit electrode 353*b*. In the example operation procedure corresponding to box 312, the pseudopotential barriers are generated by application of an auxiliary RF voltage to the exit electrode. Three different pseudopotential-modified electrical potential profiles 325*a*, 325*b*, 325*c* are schematically illustrated, corresponding to ion species of three different ink values, in accordance with Eq. 1 above. More specifically, the example profiles 325*a*, 325*b* and 325*c* pertain to ion species of $(m/z)_a$, $(m/z)_b$ and $(m/z)_c$, respectively, where $(m/z)_a>(m/z)_b>(m/z)_c$. With reference to the profile 325*a*, it may be noted that the DC potential difference between the multipole rods and the exit electrode 353*b* (i.e., between graph portions 324 and 326) is sufficiently great to overcome the pseudopotential barrier that would otherwise be formed in the vicinity of the gap 363*b*. As a result, the ions associated with the profile 325*a* are able to pass through the gap 363*b* and to exit the apparatus 352 through the exit electrode 353*b*.

Still with reference to box 312 of FIG. 4, it may be noted that the profiles 325*b* and 325*c* comprise maxima as a result of the superimposition of the pseudopotential on top of the regular DC potential gradient. Thus, the profiles 325*b* and 325*c* are pseudopotential barriers to the passage of ion species of corresponding respective m/z values. Pseudopotential barriers 325*b* and 325*c* prevent ions of the corresponding respective ions species from exiting the apparatus 352 along the axis (the ions still being confined transverse to the axis by the trapping RF potentials applied to the multipole rods, assuming that they have previously been completely thermalized within the multipole device). Therefore, the trapped ion species, for example, the species corresponding to the profiles 325*b* and 325*c*, will be prevented from exiting the quadrupole device 352 through exit electrode 353*b*. Note that the three illustrated pseudopotential-modified electrical potential profiles 325*a*, 325*b*, 325*c* of FIG. 4 are merely examples of a hypothetical infinite number of such profiles, one for each respective m/z value in accordance with Eq. 1.

Still with reference to box 312 of FIG. 4, it should be noted that it is possible to progressively release the ions corresponding to potential profiles 325*b* and 325*c* from apparatus 352 by either progressively lowering the DC potential corresponding to graph portion 326 or progressively raising the DC potential on the multipole rods corresponding to graph portion 324, or both. Alternatively, the amplitude of the applied auxiliary RF voltage applied to exit lens 353*b* may be progressively ramped downwards so as to progressively decrease the magnitude of the imposed pseudopotential, in accordance with Eq. 1. Alternatively, any two or all three options for releasing ions stored in the ion separator device may be employed at the same time. In this fashion, ions that are stored in the multipole apparatus 352 may be progressively released in accordance with their m/z values, specifically in the reverse order of their m/z values, with ions having greater m/z values being released prior to the release of ions with lesser m/z values. Thus, when operated in accordance with the present teachings, the ion storage device 352, as well as other devices employed in accordance with the present teachings, may be regarded as an ion separator.

Another method for generating the pseudopotential-modified electrical potential profiles 325*a*, 325*b*, 325*c*, and others, for different m/z values in the vicinity of gap 363*b*, is by applying the auxiliary RF voltage to the multipole rods (e.g. rods 361, 362 or 371, 372, 373, 374) instead of to an exit lens 353*b*. In such experimental setups, the auxiliary RF voltage must be applied with synchronous phase on all such rods (Kaiser N. K. et al. Controlled ion ejection from an external trap for extended m/z range in FT-ICR mass spectrometry. J Am Soc Mass Spectrom. 2014 June; 25(6):943-9). This auxiliary RF voltage is superimposed on-top of the main RF voltage that confines the ions transverse to the axis 59. When applied to the multipole rods in this fashion, the auxiliary RF voltage creates further pseudopotential-modified electrical potential profiles in the vicinity of the electrode gap 363*a* between the entrance lens 353*a* and the multipole rods, as illustrated in box 314 of FIG. 4. As is illustrated in this specific example, the offset DC potential at the entrance lens (that is, the potential difference between potential 322 and potential 324) is identical to the offset potential at the exit lens (i.e., the difference between potential 324 and potential 326). As a result, the illustrated pseudopotential-modified electrical potential profiles 323*a*, 323*b* and 323*c* correspond to the same respective m/z values for which the corresponding profiles at the opposite side of the apparatus 352 are, respectively, profiles 325*a*, 325*b* and 325*c*. If, at a certain time, $t_0$, the two offset DC potentials are not identical, then the m/z values of ions that are selectively admitted into the apparatus 352 at time, $t_0$ may differ from the m/z values of ions that are selectively released from the opposite end of the apparatus at the same time, $t_0$.

Figure 5:
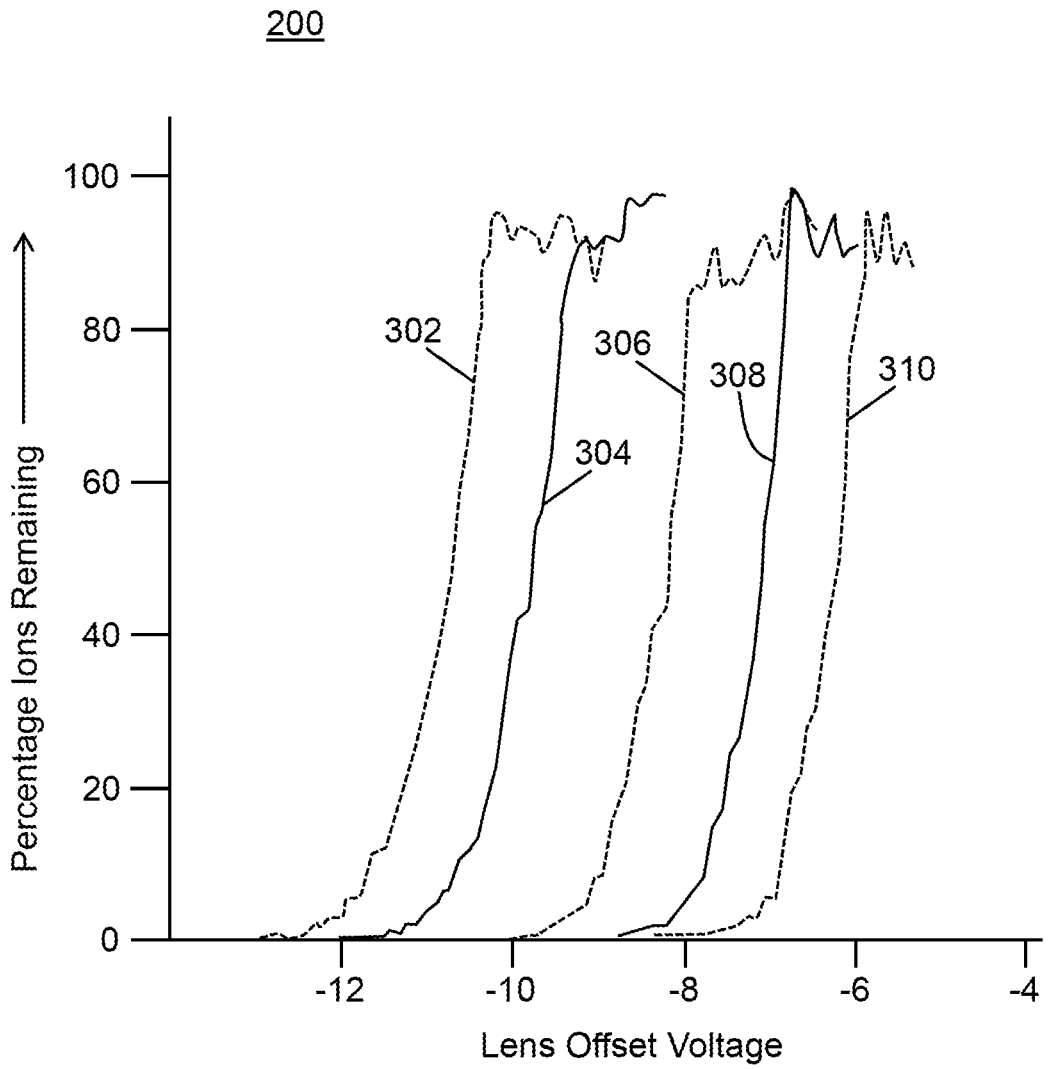
FIG. 5 is a graph of an example experimental dataset, wherein ions are sequentially ejected by varying the DC offset applied to the same lens that receives an auxiliary RF voltage, in accordance with the present teachings.

Pseudopotential-based sequential ion ejection is technically simpler than the mobility based approaches described in the background section, because pseudopotential-based ion separation ejects ions based upon their m/z ratios. As such, it is possible to accurately predict when un-characterized ions will leave the pseudopotential-based ion separator using the m/z information collected in an initial $MS^1$ survey mass spectrum. Using the methods of the present teachings, it is not necessary to experimentally measure the mobility of each precursor ion species, or indeed any other specific property of each ion, other than its m/z ratio, prior to performing the separation. FIG. 5 is a set of graphs of remaining trapped ions (values normalized to 100%) of different m/z values as the ions are selectively released from an apparatus of the type shown in FIG. 2 that is operated as described above. Specifically, graphs 302, 304, 306, 308 and 310 pertain to ion species whose m/z values are 1022, 1122, 1322, 1522 and 1721, respectively (all values in thomsons, Th). The curves shown in FIG. 5 are plotted as functions of progressively decreasing lens offset voltage, $U_{DC}$ (Eq. 2), applied to an exit lens, while the auxiliary RF voltage applied to the same lens was held constant. Accordingly, the data points depicted in FIG. 5 were generated reading from right to left across the diagram, thus confirming that ion species are released from the apparatus in the reverse order of their m/z values. When selecting sets of ions comprising a plurality of m/z values that are to be isolated and temporarily contemporaneously trapped in an ion separator in accordance with the present teachings, it is preferable to select the ion m/z values such that none of the steeply rising portions of the transmission curves (curves such as those shown in FIG. 5) overlap one another. By selecting the contemporaneously trapped ions in this fashion, it may be assured that there will not be appreciable subsequent co-release of ions of different ink values from the ion separator.

Figure 6A:
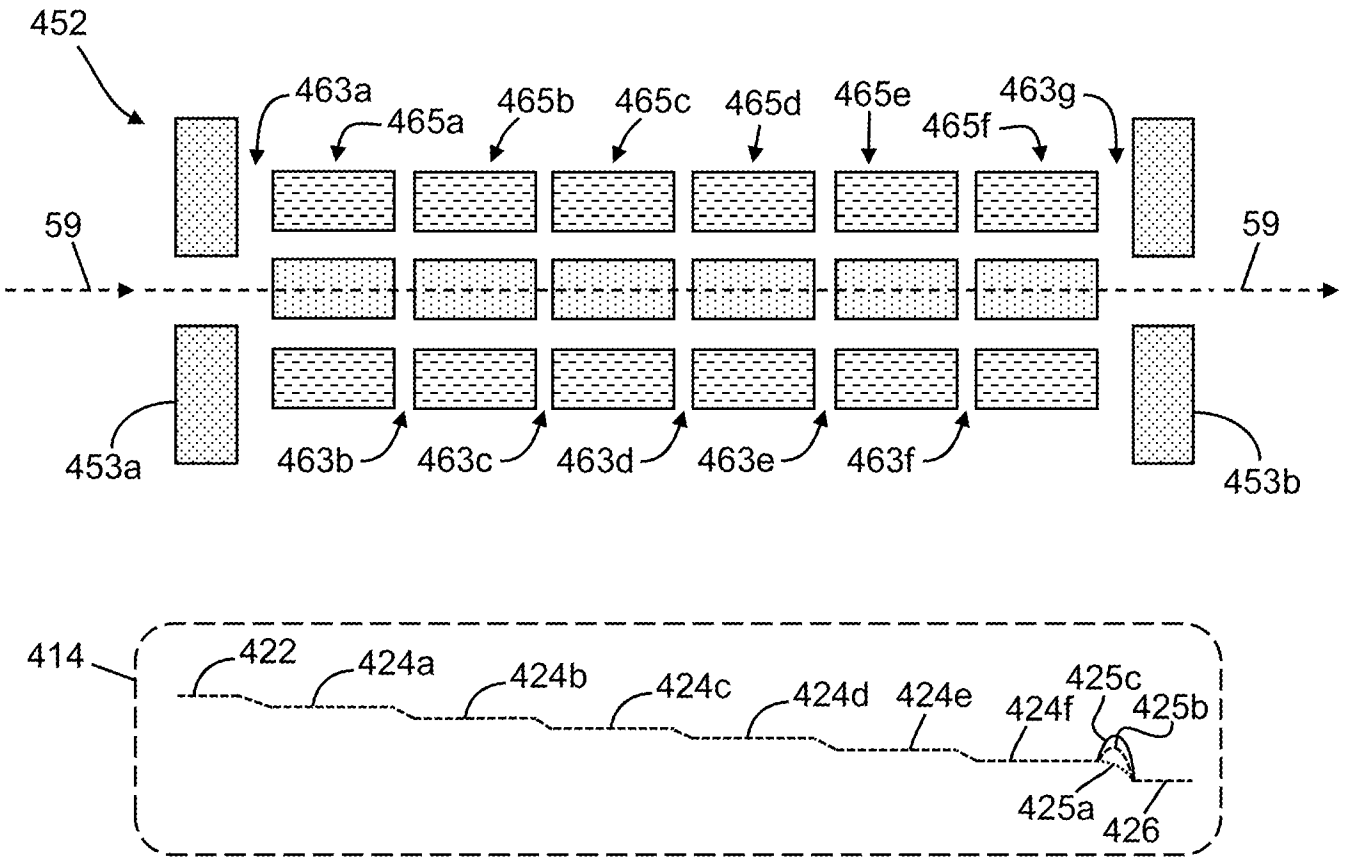
FIG. 6A is a schematic illustration of a pseudopotential and an axial potential applied to a segmented ion guide in accordance with various embodiments of the present teachings.
Figure 6B:
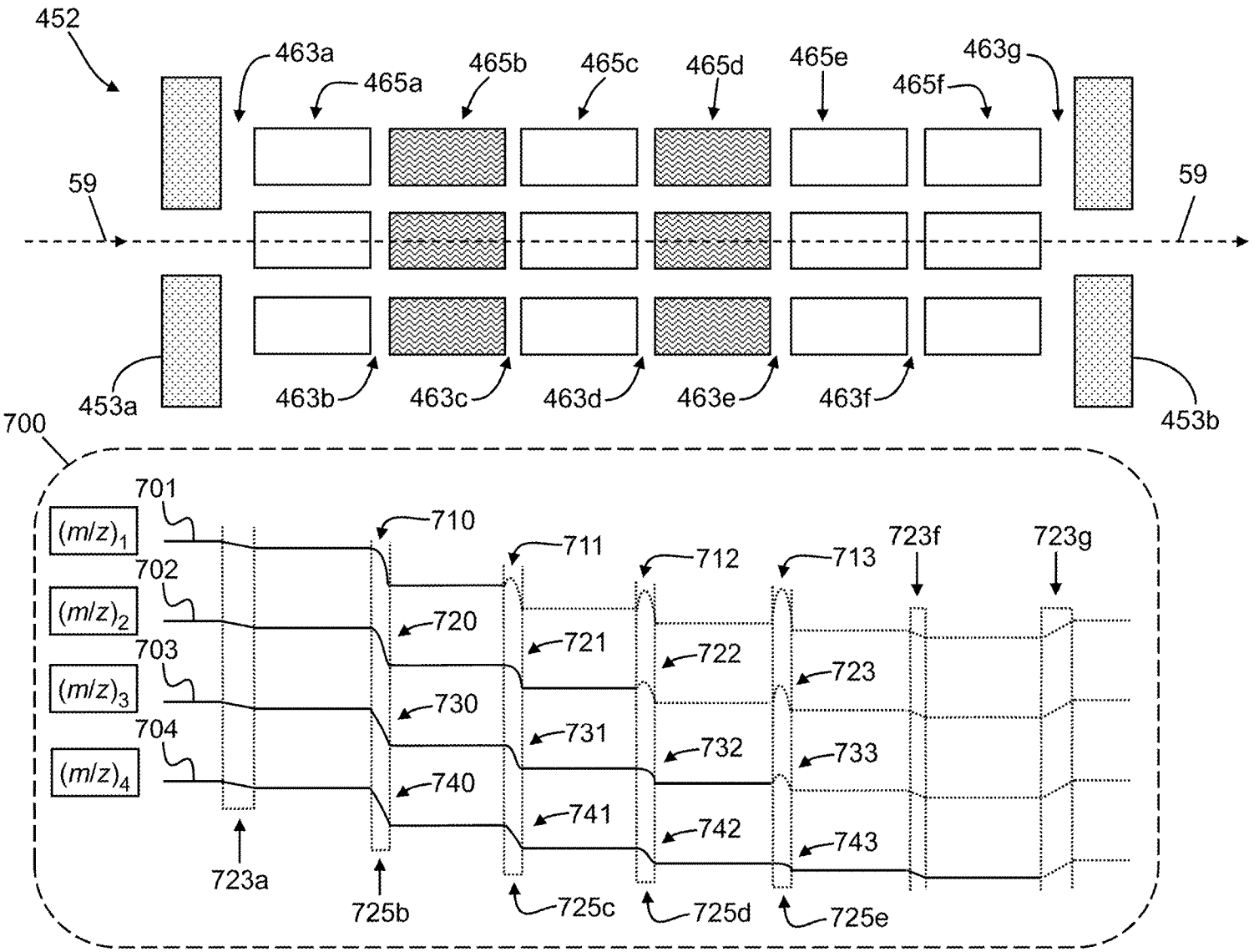
FIG. 6B is a schematic diagram of an example of the application of multiple pseudopotential barriers and extraction potentials to the segmented ion guide of FIG. 3 in accordance with various embodiments of the present teachings.
Figure 6D:
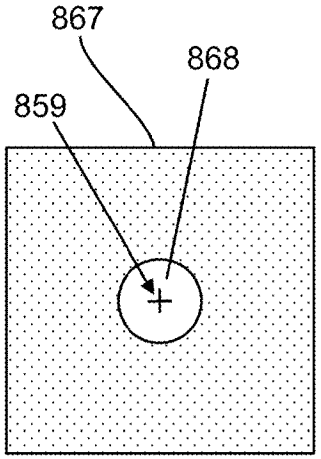
FIG. 6D is a schematic depiction of a single ring electrode of the stacked ring ion guide of FIG. 6C.

In accordance with the present teachings, the apparatus 452 may also be operated as an ion selector. FIGS. 6A and 6B illustrate two examples of such operation in accordance with the present teachings. Specifically, the operation may be achieved by configuring one or more power supplies (not shown) to provide one or more additional auxiliary RF voltages to chosen elements of the apparatus. The auxiliary RF voltages may be applied so as to create one or more pseudopotential barriers, each such pseudopotential barrier being at either: (a) the gap 463*a* between the entrance lens 453*a* and the first section 465*a* of the apparatus 452, (b) one of the gaps 463*b*-463*f* between sections or (c) the gap 463*g* between the last section 465*f* and the exit lens 453*b*. For example, box 414 of FIG. 6A schematically illustrates pseudopotential-modified electrical potential profiles 425*a*, 425*b* and 425*c* created in the vicinity of the gap 463*g* by application of an auxiliary RF voltage to the exit lens 453*b*. The example profiles 425*a*, 425*b* and 425*c* pertain to ion species of $(m/z)_d$, $(m/z)_e$ and $(m/z)_f$, respectively, where $(m/z)_d>(m/z)_e>(m/z)_f$. As noted above, the three illustrated pseudopotential-modified electrical potential profiles 425*a*-425*c* are merely examples of a hypothetical infinite number of such pseudopotential-modified profiles that may be generated at the gap 463*g*, one such profile for each respective m/z value in accordance with Eq. 1. In particular, the profile 425*a* monotonically decreases in the direction of the exit lens 453*b* within the gap 463*g* and therefore allows the egress of ions having the m/z value, $(m/z)_d$. In contrast, the profiles 425*b* and 425*c*, which are applicable to the ion species $(m/z)_e$ and $(m/z)_f$, respectively, both comprise maxima within the gap 463*g*, since the illustrated potential difference between the DC voltage 424*f* applied to the last section 465*f* and the DC voltage 426 applied to the exit lens 453*b*, is insufficient to overcome the pure pseudopotential barrier generated by the auxiliary RF voltage. Thus, with the illustrated example pseudopotential-modified electrical potential profiles 425*a*, 425*b*, the ion species $(m/z)_e$ and $(m/z)_f$ will be selectively trapped within the apparatus 452 while, at the same time, the $(m/z)_e$ ions will be pass out of the apparatus. The trapped ions may be preferentially allowed to exit, in reverse order of their respective m/z values, by varying either the amplitude of the applied auxiliary RF voltage or by varying the DC voltage difference between the DC voltage 424*f* applied to the last apparatus section 465*f* and the DC voltage 426 applied to the lens 453*b*.

In other embodiments in accordance with the present teachings, auxiliary RF voltages could be applied to one or more of the sections 465*a*-465*f* by applying the auxiliary RF voltage with synchronous RF phase and with equal amplitude and frequency to all rod segments comprising the particular section. In such cases, pseudopotential-modified electrical potential profiles will be created in gaps at both ends of the section to which the auxiliary RF voltage is applied. By controlling either the amplitude of the auxiliary RF voltage applied to the section in question or the DC voltage difference between the section in question and the components to either side of the section in question, then the m/z values of ions both entering and exiting the section may be selectively controlled.

In accordance with the present teachings, the ability to apply pseudopotential-generating auxiliary RF voltages to selected sections of the apparatus 452 provides the capability to partition the apparatus so that different ion species may be independently accumulated in different regions of the apparatus. As one example, multiple ion species having relatively low m/z values may be accumulated in different respective regions while, simultaneously, different ion species having greater m/z value(s) are allowed to pass through with minimal or no accumulation. Such operation may be advantageous in situations in which the ion species that are allowed to pass through are present in relatively high abundance so that little or no accumulation is needed. FIG. 6B schematically illustrates one example of such ion partitioning within the apparatus 452. In the example of FIG. 6B, it is assumed that auxiliary RF voltages are applied to sections 465*b* and 465*d*, as indicated by shading of the rod segments to which such auxiliary RF fields are applied. As described above, within each section, the auxiliary RF voltage is applied with identical amplitude, frequency and phase to all rod segments (e.g., six rod segments, 8 rod segments, 12 rod segments, etc.) of the section. The application of an auxiliary RF voltage to the section 465*b* creates a first pseudopotential at the gap 463*b* and a second pseudopotential at the gap 463*c*. Similarly, the application of an auxiliary RF voltage to the section 465*d* creates a third pseudopotential at the gap 463*d* and a fourth pseudopotential at the gap 463*e*. Because a separate pseudopotential is created at each end of any section to which an auxiliary RF voltage is applied, there will generally be at least one intervening section to which no auxiliary RF voltage is applied disposed between each consecutive pair of sections that receive such auxiliary RF voltage waveforms. For example, in FIG. 6B, the section 465*c* is such an intervening section that does not receive an auxiliary RF voltage. Although FIG. 6B only depicts two sections (sections 465*b* and 465*d*) that receive an auxiliary RF voltage, and only depicts six total sections, it is to be understood that additional sections could receive an auxiliary RF voltage, that the apparatus could comprise either greater or fewer total sections, and that an auxiliary RF voltage could be applied to either or both of the sections adjacent to the entrance lens 453*a* or the exit lens 453*b*.

Box 700 of FIG. 6B is a schematic depiction of four hypothetical profiles 701, 702, 703, 704 of "effective DC potential" across the length of the apparatus 452 with relation to four different ion species having mass-to-charge ratios of $(m/z)_1$, $(m/z)_2$, $(m/z)_3$, and $(m/z)_4$, respectively, where $(m/z)_1<(m/z)_2<(m/z)_3<(m/z)_4$. All four effective DC potentials 701-704 are identical except for the regions at the section gaps 463*b*, 463*c*, 463*d*, and 463*e* at which pseudopotentials are superimposed upon the applied actual DC potentials. Note that the applied DC potentials consist of the horizontal portions of the profiles. Similarly to the conventional operation of the apparatus (FIG. 3), the applied DC potentials comprise a series of downward voltage steps across the apparatus from the entrance to the exit in order to ultimately urge ions completely through the apparatus. For example, voltage steps outlined by open-ended boxes 723*a* and 723*f* in FIG. 6B are analogous to various voltage steps depicted in the profile shown in box 410 of FIG. 3. The switchable voltage step outlined by open-ended box 723*g* is also analogous to the voltage step between applied potential 424*f* and applied potential 426 depicted in FIG. 3 except that, in FIG. 6B, this step is shown in a configuration that allows the temporary accumulation of trapped ions within the apparatus.

Still with reference to FIG. 6B, it is to be noted that the voltage steps outlined by open-ended boxes 725*b*-725*e* in FIG. 6B are different in magnitude from the conventional voltage steps (e.g., the voltage steps outlined at 723*a* and 723*f*) and comprise a series of voltage steps that decrease in magnitude in sequence from box 725*b* to box 725*e*. The voltage steps at 725*b*, 725*c*, 725*d* and 725*e* correspond, respectively, to the section gaps 463*b*, 463*c*, 463*d* and 463*e* at which the applied DC potentials are superimposed upon the (m/z)-dependent pseudopotentials that result from application of auxiliary RF voltages to the sections 465*b* and 465*d* as described above. Accordingly, pseudopotential-modified potential profiles occur within the boxes 725*b*-725*e*. The modified potentials 710, 720, 730 and 740 at box 725*b* correspond to the section gap 463*b*. Similarly, the modified potentials 711, 721, 731 and 741 at box 725*c* correspond to the section gap 463*c*. Similarly, the modified potentials 712, 722, 732 and 742 at box 725*d* correspond to the section gap 463*d*. Similarly, the modified potentials 713, 723, 733 and 743 at box 725*e* correspond to the section gap 463*e*.

Each modified potential depicted in box 700 of FIG. 6B exhibits the effect of the superimposition of an (m/z)-dependent pseudopotential upon an applied DC voltage step. At the position of open-ended box 725*b*, the applied DC voltage step is of sufficiently great magnitude to overcome the blocking effect of the pseudopotentials corresponding to all the referenced ion species, i.e., each of the ion species having mass-to-charge ratios of $(m/z)_1$, $(m/z)_2$, $(m/z)_3$, and $(m/z)_4$. Accordingly, any of the plurality of these ions that enter the apparatus 452 through the entrance lens 453*a* will proceed at least through gaps 463*a* and 463*b* and into the section 465*b*.

At the position of box 725*c*, the $(m/z)_1$ species will encounter pseudopotential barrier 711. This species will therefore be obstructed form proceeding further and will be trapped in section 465*b*, since the pseudopotential is the greatest for this ion species. However, the pseudopotentials for the $(m/z)_2$ species, $(m/z)_3$ species, and $(m/z)_4$ species are insufficiently great to overcome the applied DC potential drop at 725*c*. Thus, these latter three ion species will continue their forward progress through the gap 463*c* and into the section 465*c*.

At the position of box 725*d*, corresponding to the section gap 463*d*, the magnitude of the applied DC potential drop is less than the applied DC potential drop at box 725*c*. Accordingly, at 725*d*, the $(m/z)_2$ ion species will encounter pseudopotential barrier 722. Since the pseudopotential corresponding to this ion species is greater than the pseudopotentials corresponding to the $(m/z)_3$ species and the $(m/z)_4$ species, the $(m/z)_2$ ion species will thus be trapped in section 465*c*. At the same position, the pseudopotentials for the ion species $(m/z)_3$ and $(m/z)_4$ are insufficiently great to overcome the applied DC potential drop at 725*d*. Thus, these latter two ion species will continue their forward progress through the gap 463*d* and into the section 465*d*.

A similar separation of the $(m/z)_3$ species from the $(m/z)_4$ species occurs at the position of box 725*e*, at which the $(m/z)_3$ species encounters the pseudopotential barrier 733 but the $(m/z)_4$ species does not encounter such a barrier. Thus, the $(m/z)_3$ species will be trapped in section 465*d* while the $(m/z)_4$ species may proceed forward through the apparatus 452 to the minimum applied DC potential adjacent to the exit lens 453*b*. Alternatively, the applied potential on the exit lens 453*b* may be configured to allow the $(m/z)_4$ species to exit the apparatus.

By the above-described process, it is possible to independently control the accumulation of ions species of different m/z values through the apparatus 452. Following accumulation, the ion species may then be released from the apparatus to a downstream component of a mass spectrometer system in the order $(m/z)_4$ followed by $(m/z)_3$ followed by $(m/z)_2$ followed, finally, by $(m/z)_1$. In the illustrated example of FIG. 6B, the $(m/z)_4$ species may be released by re-configuring the applied DC potential at the exit lens 453*b*. The accumulated $(m/z)_3$ species then may be released by either lowering the amplitude of the auxiliary RF voltage applied to section 465*d* by an appropriate amount, by raising the applied DC potential on section 465*d* by an appropriate amount, by lowering the DC potential applied to section 465*e*, or by some combination of the above. The appropriate amount of any such voltage or potential lowering or raising is chosen such that the potential barrier 733 disappears while, at the same time, the potential barriers 722 and 711 remain. As the same time that the $(m/z)_3$ species is being released from the apparatus, the same amplitude or potential adjustments may cause the $(m/z)_2$ species to migrate forward to position 725*e*. Following the release of the $(m/z)_3$ species from the apparatus, a similar procedure may be employed to release just the $(m/z)_2$ species while maintaining the trapping of the $(m/z)_1$ species. Finally, the $(m/z)_1$ species is released.

In the above-described fashion, the accumulation of each one of different ion species comprising different respective m/z values may be independently controlled, even though the introduction of, the accumulation of, and/or the release of different species may occur at least partially contemporaneously. In view of the above teachings, one of ordinary skill in the art would be able to readily envisage various different modes of operation of a segmented ion separator apparatus, as exemplified by the separator apparatus 452, said various different modes of operation comprising sequences or orders of ion species introduction, accumulation, and release that are different than those explicitly described above. Such different sequences and/or orders of events may possibly include different sequences of applied auxiliary RF and DC voltages to the components of the apparatus, as would be readily understood by one of ordinary skill in the art.

Figure 6C:
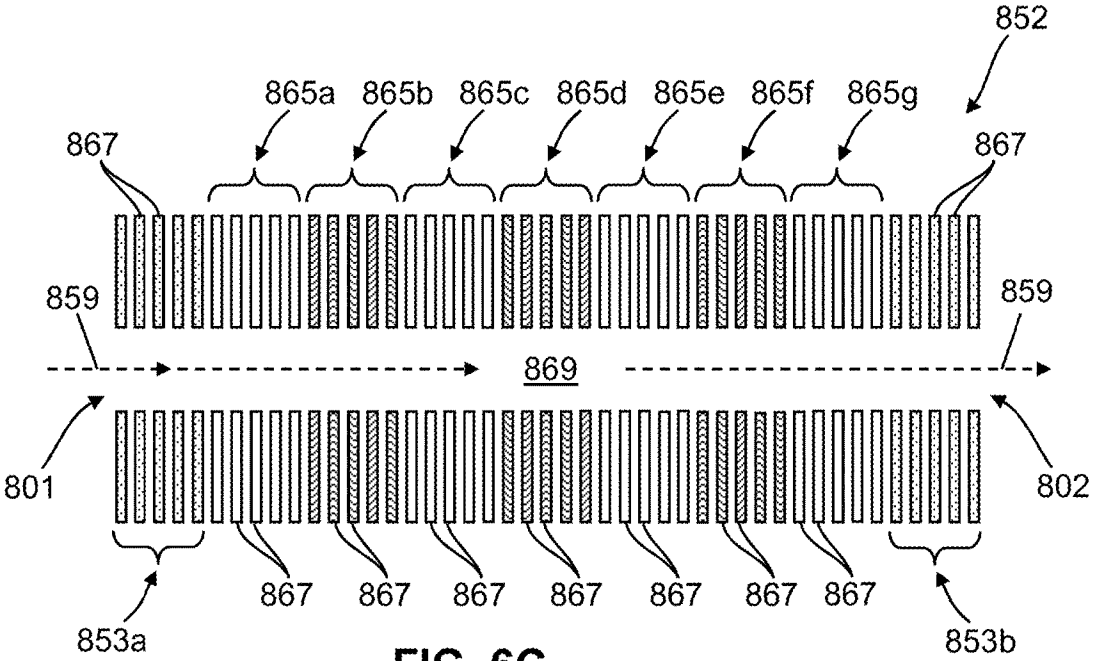
FIG. 6C is a schematic illustration of a longitudinal section of a stacked ring ion guide comprising a plurality of ring electrodes that to which are applied multiple pseudopotential barriers and extraction potentials in accordance with various embodiments of the present teachings.

It should be appreciated that, in various alternative embodiments of apparatuses in accordance with the present teachings, any instance of a set of rod electrodes as described in this document may be replaced by a stacked ring ion guide. Further, it should be appreciated that any instance of an entrance lens or exit lens as described herein may likewise be replaced by a stacked ring ion guide. Accordingly, FIG. 6C illustrates a longitudinal cross section of another ion storage apparatus 852 in accordance with the present teachings in which both the rod electrode sets and the entrance and exit lenses are replaced by a single continuous stack of ring electrodes, each such ring electrode comprising an electrode plate 867, a representative one of which is illustrated in face-on view in FIG. 6D.

In the ion storage apparatus 852, a plurality of electrode plates 867 comprise a generally evenly-spaced-apart stack or series of electrodes progressing from an entrance end 801 to an exit end 802 of the apparatus. The electrodes may all be formed similarly to the single plate electrode 867 illustrated in FIG. 6D, each such electrode comprising an aperture 868. When arranged as a stack, as schematically depicted in FIG. 6C, the set of aligned apertures 868 together form an ion channel 869 that extends from the entrance end 801 to the exit end 802 of the apparatus 852. It should be kept in mind that, although the plates 867 are depicted, in FIG. 6D, as being rectangular in shape and having circular apertures 868, neither the shapes of the plates nor the shapes of the apertures are limited to any particular shape or shapes. For example, the apertures may be oval or polygonal in shape. As another example the plates may comprise essentially circular rings. Further, the plates may comprise various mounting structures, such as tabs or grooves, for the purpose of mounting within an alignment structure (not shown) and may also comprise electrical contact points or leads (not shown) for purposes of supplying electrical AC and DC voltages to the various plates.

As is known in the art, an RF confining voltage may be applied to the stacked electrode plates 867 of the apparatus 852 so as to confine ions to a restricted region about an axis 859 that is centrally located within the ion channel 869. The RF confining voltage is applied such that all electrode plates within the stack receive the same RF amplitude but such that the RF phase applied to adjacent plates is 180-degrees out of phase. In other words, if the plates are consecutively numbered, commencing with plate "number 1" at the entrance end 801 of the apparatus, then the RF applied to all odd numbered plates is in phase and the RF applied to all even numbered plates is likewise in phase but there is an RF phase difference of 180-degrees between the even- and odd-numbered plates. The plate-to-plate alternating RF phase serves to maintain ions in the vicinity of the central axis 859 within the ion channel 869 of the apparatus 852. In the schematic depiction illustrated in FIG. 8C, the various electrode plates 867 are illustrated as being mutually aligned such that the ion channel 869 and the axis 859 are essentially straight. Nonetheless, it should be kept in mind that the plates may, in some embodiments be offset relative to one another (either offset vertically within the plane of the drawing of FIG. 6C or offset out of the plane of the drawing) such that portions of or the entirety of the channel 869 is curved.

The novel aspects of the operation of the stacked ring ion guide apparatus 852 in accordance with the present teachings are that, in addition to the RF confining voltage, an further auxiliary RF voltage may be applied to certain selected subsets of the plate electrodes and adjustable DC offset voltages may be applied to the same selected subsets. The auxiliary RF voltage applied to each such selected subset, which is applied in addition to the RF confining voltage, is applied such that all electrodes of the selected subset receive the same RF amplitude and same synchronous frequency and phase. The selective application of the auxiliary RF voltage thus logically divides the stacked ring ion guide into segments, even though the physical structure of the plate electrodes need not differ between different segments. For example, in the schematic illustration of FIG. 6C, the apparatus 852 includes seven such segments, 865*a*-865*g*, which are formed through the selective application of the auxiliary RF voltage to the plate electrodes (shaded) of segments 865*b*, 865*d* and 865*f*. In this example, the plate electrodes of the other segments 865*a*, 865*c*, 865*e* and 865*g* do not receive the auxiliary RF voltage.

The selective application of an auxiliary RF voltage to certain subsets of the plate electrodes of the stacked ring ion guide apparatus 852 creates a pseudopotential barrier at each end of each segment that receives an auxiliary RF voltage, in a similar fashion as described above with regard to the apparatus 452 (FIGS. 6A-6B). Accordingly, with the application of auxiliary RF voltages as depicted in FIG. 6C (i.e., to the shaded electrodes of segments 865*b*, 865*d* and 865*f*), a respective pseudopotential barrier is generated between each pair of adjacent segments. Thus, application of the auxiliary RF voltages to selected segments taken together with coordinated application of DC offset voltages between segments permits the apparatus 852 of FIG. 6C to be operated as a selective ion accumulation apparatus similar to the previously described operation of the rod-electrode-based apparatus 452 (FIGS. 6A-6B). Voltage profiles similar to those illustrated in the lower half of FIG. 6B may be applied likewise to and between the segments of the apparatus 852 to achieve similar ion accumulation/selection/transmission results as described previously.

An additional (but not necessarily essential) feature of the apparatus 852 (FIG. 6C) is that the entrance and exit lenses are incorporated as part of the same electrode stack that is utilized for ion accumulation, storage, selection, and transmission. In FIG. 6C, the entrance and exit segments 853*a*, 853*b* of the apparatus 852 (FIG. 6C) are analogous to the entrance lens 453*a* and exit lens 453*b*, respectively, of the apparatus 452 (FIGS. 6A-6B). In general, no auxiliary RF voltages are applied to electrodes of the entrance and exit segments 853*a*, 853*b*. However, the RF confining voltage is generally applied, and DC offset voltages may be applied, to the electrodes of the entrance and exit segments 853*a*, 853*b*. The stacked ring ion guide device 852 (FIG. 6C) provides an optional operational feature, relative to the apparatus 452 (FIGS. 6A-6B), in that an axial field or "drag field" may be applied within one or more of the segments, including segments, 865*a*-865*g* and entrance and exit segments 853*a*, 853*b*. The axial, or drag field, may be applied to assist ion movement in the direction of the arrows depicted on axis 859 within any such segment by applying varying DC offset voltages between individual plate electrodes 867 of the segment. It may also be noted that axial/drag fields may be created within any of the rod-based apparatuses 352, 452, 552 described herein using any one of a variety of methods, such as the methods taught in U.S. Pat. No. 7,675,031 in the names of inventors Konicek et al.; U.S. Pat. No. 5,847,386 in the names of inventors Thomson et al; and U.S. Pat. No. 6,163,032 in the name of inventor Rockwood, among others.

Figure 7:
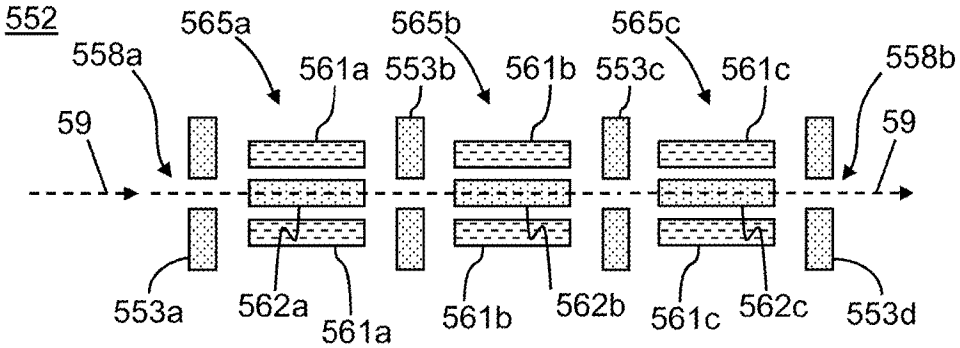
FIG. 7 is a schematic diagram of an ion guide apparatus having multiple multipole segments separated by ion lenses in accordance with various embodiments of the present teachings.

According to another implementation of the present teachings, as exemplified by the schematically illustrated apparatus 552 shown in FIG. 7, it is possible to create a series of pseudopotential barriers by dividing a linear ion guide into a series of discrete sections, e.g., sections 565*a*-565*c*, using a series of lenses (e.g., lenses 553*a*-553*d*) that are disposed between each set of rod electrodes. According to the exemplary embodiment shown in FIG. 7, the multipole apparatus is comprised of four rods. As illustrated, section 565*a* comprises rod electrodes 561*a* and 562*a*, section 565*b* comprises rod electrodes 561*b* and 562*b*, and section 565*c* comprises rod electrodes 561*c* and 562*c*. Although the sections are shown with four rods, various embodiments of the apparatus may comprise multipole sections that include more than four rods, such as six, eight, ten, twelve rods, etc. Alternatively, the rod electrodes of one, some, or all of the sections could be replaced by a respective stacked ring ion guide that comprises a plurality of plate electrodes as previously noted. Each of the lenses 553*a*-553*d* is provided with a respective DC voltage that is controlled so as to either: (a) permit all ions to pass through the lens, in the general direction from the apparatus entrance end 558*a* to the exit end 558*b*, without discrimination according to the ions' m/z values; (b) prevent all ions from passing through the lens (i.e., trap all ions) or (c) to selectively permit ions to pass through the lens in accordance with their m/z values. The first two listed operations are conventional; the last operation is performed with application of an auxiliary RF voltage to the lens so as to create a pseudopotential profile, as described above. Each lens may be operated independently of the others and the same operation may be performed by more than one of the apparatus sections 565*a*-565*c*, such that ions of different m/z values may be temporarily partitioned into different sections and caused to exit from the apparatus 552 at different times.

According to other modes of operation of the apparatus 552, an auxiliary RF voltage may be applied with synchronous phase to all rod electrodes of a section, while the DC voltages applied to the neighboring lenses are simultaneously adjusted so as to selectively admit ions into the section in accordance with their m/z values and, simultaneously, selectively release ions from the section in accordance with their m/z values. The m/z values of the ions that are admitted into the section may differ from the m/z values of ions that are being released from the section. More than one section of the apparatus may be selectively populated in this fashion.

Figure 8:
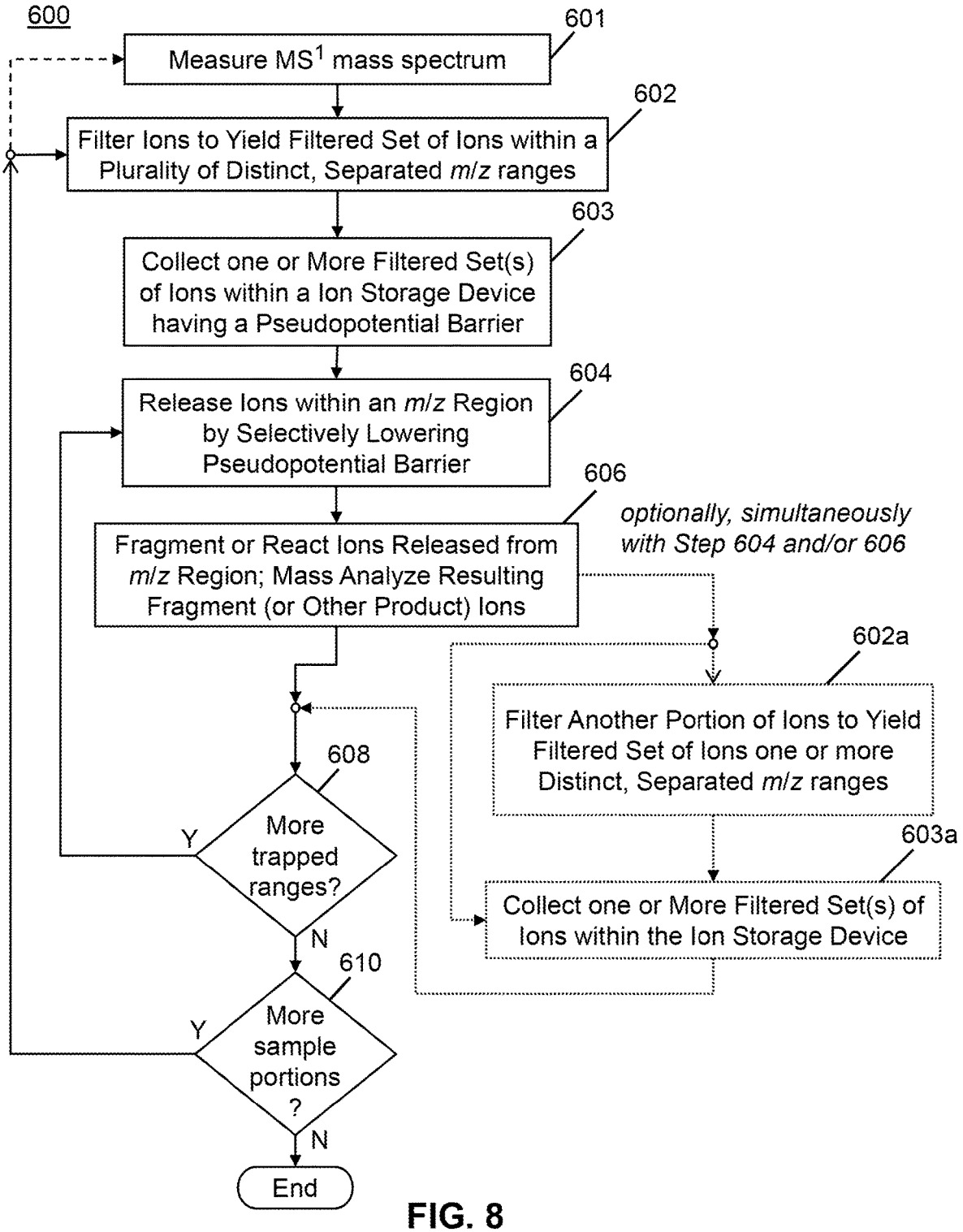
FIG. 8 is a flowchart of a method in accordance with the present teachings.

FIG. 8 is a flow chart of a generalized method (method 600) for operating a mass spectrometer in accordance with the present teachings. In Step 601 of the method 600, a survey mass spectrum may be measured in order to characterize the ions that are being delivered to the mass filtering and mass analysis stages of a mass spectrometer from an ionization source, possibly as modified by in-source fragmentation. The measurement of this mass spectrum, which is sometimes referred to as an "$MS^1$" spectrum or "survey scan", or "survey mass spectrum", may be performed in order to select precursor ion species of certain m/z values for subsequent $MS^n$ analyses. The Step 601 may be skipped in some circumstances such as, for example, when a sample is well-characterized, if the precursor ions have been previously characterized, or if the method is comprised of expected "targeted" precursors. In Step 602, a sample portion of ions or, otherwise, a continuous stream of ions is filtered, such as by a quadrupole mass filter, so as to eliminate ions within all mass-to-charge (m/z) regions except for ions within a plurality of certain pre-selected, distinct, separated ranges of m/z (i.e., m/z ranges). In some cases, these pre-selected regions are determined based upon the survey scan collected in step 601. Typically, each m/z range will encompass a respective, pre-determined, m/z value of a precursor ion species, which is to be further manipulated after the elimination of other ions species. In some embodiments, the execution of Step 602 may comprise sequential isolations of each of the various m/z ranges, in sequential order, in a fashion similar to conventional mass filtering. In such embodiments, the execution of Step 602 may comprise repeatedly eliminating all ions except for ions within a specific respective one of the pre-selected m/z ranges, where each such isolation step operates on a different portion of a continuous ion stream. In alternative embodiments, the execution of Step 602 may comprise a multi-notch isolation, whereby the plurality of pre-selected m/z ranges are co-isolated. The principles of multi-notch isolation are described, for example, in U.S. Pat. No. 9,048,074 as well as in Soni, M H and Cooks R G, Selective Injection and Isolation of Ions in Quadrupole Ion Trap Mass Spectrometry Using Notched Waveforms Created Using the Inverse Fourier Transform, Anal. Chem., 1994, 66 (15), pp 2488-2496, both of which are hereby incorporated by reference in their entirety.

In Step 603 of the method 600 (FIG. 8), the various ion species within the plurality of pre-selected, distinct, separated, m/z ranges, as filtered in Step 602, are collected and accumulated within an ion separation device that is provided with the capability of generating an auxiliary oscillatory voltage that can generate one or more pseudopotential barriers for at least some ion species. The application of the auxiliary oscillatory voltage may be active at the time that ions are accumulated in the ion separation device. In such cases, the pseudopotential barriers may be employed to temporarily trap ions. Alternatively, the initial ion trapping may be effected by conventional means (e.g., DC lens voltages), after which the auxiliary oscillatory voltage is applied. The ion separation device is, preferably, a multipole device comprised of sets of rods (e.g., 4 rods, 6 rods, 8 rods, etc.). In some embodiments, the ion separation device may be a multipole device that is otherwise employed as an ion guide at times when the pseudopotential barrier is not applied, or as an ion trap or ion activation cell, or when methods in accordance with the present teachings are not executed. The accumulation of ions within the ion separation device will generally, but not necessarily, occur simultaneously with the ion filtering step 602, as ion species within the isolated m/z ranges may pass through the mass filter device unimpeded directly to the ion separation device. Otherwise, ion storage within the ion separation device, to which the pseudopotential barrier is applied, may not occur simultaneously with ion filtering if a different device operates as an intermediate ion separation device or ion storage device. The ion separation device associated with the pseudopotential barrier may comprise any one of the exemplary ion separation devices described in this document. However, other forms of ion separation devices that employ one or more pseudopotential barriers, possibly within segmented or partitioned ion traps, or possibly within sequentially arranged multipole traps, are also contemplated even if not explicitly described herein.

In Step 604 of the method 600, ions within a single one of the m/z ranges are selectively released from the ion separation device by lowering of the pseudopotential barrier as described previously. In other embodiments, the ions may be given enough energy to overcome the pseudopotential barrier. The released ions will generally comprise precursor ions within a single one of the m/z ranges. Following release of these ions from the pseudopotential-based ion separation device, the individual precursor ion populations can undergo further ion manipulations and m/z analysis or analyses in Step 606. In various alternative experimental situations, the analysis or analyses may occur in a multipole ion trap, a linear quadrupole mass analyzer, an electrostatic trap mass analyzer (such as an ORBITRAP™ mass analyzer or a Cassini trap mass analyzer), or a time-of-flight mass analyzer. In some cases, the ion manipulations might involve additional rounds of ion isolation, and still further manipulation. In some cases, the further ion manipulations and m/z analysis or analyses may employ additional ion traps, ion filters, or mass analyzers included within the same mass spectrometer system within which the preceding method steps are executed.

The exact form of the ion manipulations and analyses performed on the released ions in Step 606 will vary depending upon the type of application or experiment. For example, in a common form of ion manipulation, the released precursor ions are transmitted from the ion separation device to an ion fragmentation or reaction cell. These precursor ions may then be manipulated in the fragmentation or reaction cell in accordance with the general techniques of tandem mass spectrometry. For example, the released precursor ions may be fragmented or otherwise manipulated by controlled ion-ion reactions so as to generate product ions. Electron transfer dissociation is one type of ion/ion reaction. Proton transfer is another ion-ion reaction that could take place in such a reaction cell. The so-generated product ions are then mass analyzed in mass analyzer components of a mass spectrometer (Step 606).

The fragmentation or reaction cell may have one of many known types that receive precursor ions and that generate product ions by fragmentation or reaction of the precursor ions. For example, in various embodiments, the cell may be of a type in which precursor ions are caused to collide with neutral gas molecules such that internal vibrational energy is imparted to the ions, ultimately leading to breakage of certain chemical bonds. Such cell types include fragmentation cells that operate according to the method of collision induced dissociation (CID) or higher-energy collisional dissociation (HCD). Alternatively, the ions may be caused to fragment in the cell by the process of surface-induced dissociation (SID). Alternatively, the cell may be a cell that causes fragmentation by electron capture dissociation (ECD), in which precursor ions are bombarded with electrons. Alternatively, the cell may be coupled to a light source, such as an ultraviolet (UV)-emitting or infrared (IR)-emitting laser that imparts photonic energy to the precursor ions that causes them to dissociate. All such examples of fragmentation/reaction cells, as well as others, are contemplated for use in conjunction with methods, apparatuses, and systems in accordance with the present teachings.

The fragmentation or reaction and mass analysis operations of Step 606 may optionally be accompanied by simultaneous execution of Step 603*a* and, possibly, also Step 602*a*, as indicated by dotted lines in FIG. 8. In the optional Step 603*a*, the ion separation device may be replenished or augmented with one or more filtered sets of ions (each such set comprising ions within a one of the pre-determined m/z ranges) to replace or augment the ions released in the prior execution of Step 606. Alternatively, Step 603*a* may comprise the introduction into the ion separation device of ions of one or more m/z ranges that were not previously introduced into the ion separation device during an experiment in question. Such replenishment or introduction of a new set of ions will generally occur once the ion separation device has been emptied of all sets of ions and will generally be accompanied by ion filtering in Step 602*a*.

After execution of the fragmentation or reaction and product-ion mass analyses of Step 606, if there are additional trapped m/z ranges in the ion separation device (Step 608), then execution of the method 600 returns to Step 604 at which point trapped ions within a different m/z range (with respect to the m/z range released just prior) are released into the ion fragmentation or reaction cell. The progression of selective releasing of different sets of ions, where each set corresponds to a different respective m/z range, may be better understood with reference to FIG. 5. With reference to both FIG. 8 and FIG. 5, assume that the selective filtering in Step 602 of the method 600 has caused sets of ions corresponding to just those ions corresponding to curves 302, 306 and 310 to be accumulated in an ion separation device (Step 603 of the method 600). Following the accumulation, the lens offset voltage (which is used to overcome an applied pseudopotential barrier) may be ramped downwards according to the values from listed right to left across the horizontal axis of FIG. 5. The graph 200 shows that initial release of the ions corresponding to curve 310 will begin at an offset voltage of about −5.8 V and, further, that such ions will be essentially emptied from the ion separation device at an offset voltage of about −8.0 V. The graph further indicates that initial release of the ions corresponding to curve 306 will begin at an offset voltage of about −8.5 V and that such ions will be essentially fully emptied from the ion separation device at an offset voltage of about −10.0 V. Finally, the ions corresponding to curve 302 will begin to be released at about an offset voltage −10.5 V, and that these latter ions will be essentially fully emptied from the ion separation device at an offset voltage of about −13.0 V. The release of each such set of ions corresponds to a separate iteration or re-iteration of Step 604 of FIG. 8.

Once the ion separation device has been emptied of all previously trapped sets of ions, it is determined, in Step 610 of the method 600, if there are additional sample portions which are to be analyzed. Such different sample portions will generally correspond to different samples of a continuous stream of ions that is generated by an ion source in response to a continuous stream of fluid sample that is provided to the ion source. If a subsequent sample portion is to be analyzed (Step 610), then execution of the method 600 returns to either Step 601 or Step 602. A subsequent sample portion could include the same sets of ions that were generated in a previous sample portion or, otherwise, could include different sets of ions. If it is known or can be assumed that the subsequent sample portion merely includes the same sets of ions that were generated in a previous sample portion, the Step 601 might be bypassed. However, the ions could differ between iterations of Step 602 because of changing sample composition caused by fractionation in a chromatographic column. Even in the event that a subsequent sample portion includes exactly the same sets of ions as a prior sample portion (for example, if the composition of the sample stream has not changed), the analysis of the subsequent portion might be directed to different sets of ions than were analyzed in the analysis of the prior portion. For example, once again with reference to FIG. 5, if the sets of ions corresponding to curves 302, 306 and 310 are accumulated in the prior iteration of Step 602 (and subsequently fragmented after accumulation in the following Step 606) then the subsequent iteration of Step 602 may comprise accumulation of the sets of ions corresponding to curves 304 and 308. Inspection of graph 200 in FIG. 5 shows that choosing, in such fashion, which sets of ions are to be accumulated and analyzed in each iteration of the Steps 602-610 allows maximum discrimination of ion species.

The discussion included in this application is intended to serve as a basic description. The present invention is not intended to be limited in scope by the specific embodiments described herein, which are intended as single illustrations of individual aspects of the invention, and functionally equivalent methods and components are within the scope of the invention. Indeed, various modifications of the invention, in addition to those shown and described herein will become apparent to those skilled in the art from the foregoing description and accompanying drawings. Such modifications are intended to fall within the scope of the appended claims. Any patents, patent applications, patent application publications, or other literature mentioned herein are hereby incorporated by reference herein in their respective entirety as if fully set forth herein, except that, in the event of any conflict between the incorporated reference and the present specification, the language of the present specification will control.

What is claimed is:

1. A method for mass spectrometric analysis of ions of a plurality of ion species generated by ionization of a sample, comprising:

(a) isolating a plurality of portions of the ions, each portion consisting of a subset of the ion species within a respective range of mass-to-charge (m/z) values;

(b) simultaneously retaining the isolated plurality of portions of the ions in an ion storage apparatus, wherein the retaining is at least partially facilitated by applying an auxiliary radio-frequency (RF) voltage waveform to a one of two electrode members of the ion storage apparatus, thereby generating a pseudopotential between the two electrode members, each electrode member either consisting of a single electrode or comprising a group of electrodes;

(c) releasing the retained isolated portions of the ion species one at a time from the ion storage apparatus, the releasing comprising one or more of: varying a DC potential applied to a one of the electrode members, varying DC potentials applied to both of the electrode members, or reducing an amplitude of the applied auxiliary RF voltage waveform; and (d) fragmenting or reacting each released portion of the ion species to thereby generate a respective set of product ion species and mass analyzing the product ion species.

2. A method as recited in claim 1, wherein:

the step (a) of isolating a plurality of portions of the ion species comprises:

generating each portion, one at a time, by passing a continuous beam comprising a plurality of ions that includes all of the ion species through a mass filter while operating the mass filter so as to eject all ion species other than ion species within the respective range of mass-to-charge (m/z) values corresponding to the portion; and the step (b) of simultaneously retaining the isolated plurality of portions of the ions in an ion storage apparatus comprises:

receiving and trapping each of the generated portions, one at a time, from the mass filter as they are generated.

3. A method as recited in claim 1, wherein:

the step (a) of isolating a plurality of portions of the ion species comprises:

generating the plurality of portions, simultaneously, by passing a continuous beam comprising a plurality of ions that includes all of the ion species through a mass filter while operating the mass filter so as to eject all ion species other than ion species within any one of the respective ranges of mass-to-charge (m/z) values corresponding to the plurality of portions; and the step (b) of simultaneously retaining the isolated plurality of portions of the ions in an ion storage apparatus comprises:

receiving the plurality of portions simultaneously and trapping the plurality of portions as they are received.

4. A method as recited in claim 1, wherein:

the step (b) of simultaneously retaining the isolated plurality of portions of the ions in an ion storage apparatus comprises applying the auxiliary radio-frequency (RF) voltage waveform to an exit lens of a multipole apparatus.

5. A method as recited in claim 1, wherein:

the step (b) of simultaneously retaining the isolated plurality of portions of the ions in an ion storage apparatus comprises applying the auxiliary radio-frequency (RF) voltage waveform to a plurality of rod electrodes of a multipole apparatus, wherein the waveform applied to each rod electrode of the plurality of rod electrodes comprises a same phase, amplitude, and frequency as does a voltage waveform applied to each other rod electrode.

6. A method as recited in claim 1, wherein:

the step (b) of simultaneously retaining the isolated plurality of portions of the ions in an ion storage apparatus comprises applying the auxiliary radio-frequency (RF) voltage waveform to a plurality of rod electrode segments of a section of a multipole apparatus, wherein the waveform applied to each rod electrode segment of the section comprises a same phase, amplitude, and frequency as a waveform applied to each other rod electrode segment of the section.

7. A method as recited in claim 1, wherein:

the step (b) of simultaneously retaining the isolated plurality of portions of the ions in an ion storage apparatus comprises applying the auxiliary radio-frequency (RF) voltage waveform to all plate electrodes of a section of a stacked ring ion guide, wherein the waveform applied to each plate electrode of the section comprises a same phase, amplitude, and frequency as the waveform applied to each other plate electrode of the section.

8. A method as recited in claim 1, further comprising:

(e) isolating a second plurality of portions of the ions, each portion consisting of a subset of the ion species within a respective range of mass-to-charge (in/z) values; and (f) simultaneously retaining the isolated second plurality of portions of the ions in the ion storage apparatus, wherein the retaining is at least partially facilitated by applying the auxiliary radio-frequency (RF) voltage waveform to the one of the two electrode members of the ion storage apparatus, thereby generating the pseudopotential between the two electrode members, wherein the steps (e) and (f) are performed simultaneously with the execution of the step (d) of fragmenting or reacting and mass analyzing.

9. A method as recited in claim 1, further comprising:

(e) isolating a second plurality of portions of the ions, each portion consisting of a subset of the ion species within a respective range of mass-to-charge (m/z) values; and (f) simultaneously retaining the isolated second plurality of portions of the ions in the ion storage apparatus, wherein the retaining is at least partially facilitated by applying the auxiliary radio-frequency (RF) voltage waveform to the one of the two electrode members of the ion storage apparatus, thereby generating the pseudopotential between the two electrode members, wherein the step (f) is performed simultaneously with the execution of the releasing step (c).

10. A mass spectrometer system comprising:

(i) an ionization source;

(ii) a mass filter apparatus configured to receive ions from the ionization source;

(iii) a fragmentation or reaction cell configured to receive ions filtered according to mass-to-charge ratio (in/z) by the mass filter and to trap and/or fragment or react the received ions so as to thereby generate product ions;

(iv) a mass analyzer configured to receive, mass analyze and detect the product ions;

(v) an ion guide having an axis, the ion guide comprising:

(a) an entrance lens configured to receive the filtered ions from the mass filter;

(b) an exit lens disposed downstream from the entrance lens and configured to transmit the filtered ions to the fragmentation or reaction cell; and (c) a plurality of electrodes disposed between the entrance and exit lenses; and (vi) one or more power supplies electrically coupled to the ion guide, the fragmentation or reaction cell and the mass analyzer, the one or more power supplies are configured to:

supply an oscillatory radio-frequency (RF) voltage to the plurality of electrodes that confines ions within the ion guide to a vicinity of the axis;

supply an auxiliary radio-frequency (RF) voltage waveform either to the exit lens or, with phase synchronicity, to all of the electrodes disposed between the entrance and exit lenses; and supply a variable DC potential difference between the plurality of electrodes and the exit lens.

11. A mass spectrometer system as recited in claim 10, wherein the plurality of electrodes comprises a set of mutually parallel rod electrodes that are parallel to and symmetrically disposed about the axis.

12. A mass spectrometer system as recited in claim 10, wherein the plurality of electrodes comprises a set of stacked plate electrodes, each plate electrode comprising an aperture, the plurality of apertures defining an ion channel through the ion guide between the entrance and exit lenses.

13. A mass spectrometer system as recited in claim 10, further comprising:

(vii) an electronic controller or computer processor comprising machine-readable program instructions operable to cause the one or more power supplies to vary one or both of an amplitude of the auxiliary RF voltage waveform and the variable DC potential difference such that ions are prevented from exiting the ion guide.

14. A mass spectrometer system as recited in claim 13, wherein the electronic controller or computer processor further comprises machine-readable program instructions operable to further cause the one or more power supplies to vary one or both of the amplitude of the auxiliary RF voltage waveform and the variable DC potential difference such that ion species are released from the ion guide in accordance with their respective m/z values.

15. A mass spectrometer system as recited in claim 10, wherein the electronic controller or computer processor further comprises machine-readable program instructions operable to cause the fragmentation or reaction cell to either fragment or react each released ion species as it is received from the ion guide.

16. A mass spectrometer system comprising:

(i) an ionization source;

(ii) a mass filter apparatus configured to receive ions from the ionization source;

(iii) a fragmentation or reaction cell configured to receive ions filtered according to mass-to-charge ratio (m/z) by the mass filter and to trap and/or fragment or react the received ions so as to thereby generate product ions;

(iv) a mass analyzer configured to receive, mass analyze and detect the product ions;

(v) an ion guide configured to receive the filtered ions from the mass filter and to transmit the filtered ions to the fragmentation or reaction cell, the ion guide comprising:

an entrance end and an ion exit end;

an axis extending between the ion entrance and exit ends; and a sequence of sections disposed along the axis from the entrance lens to the exit lens, each section comprising:

a stack of two or more plate electrodes, each plate electrode comprising an aperture, the plurality of apertures of all plate electrodes defining an ion channel through the ion guide;

(vi) one or more power supplies electrically coupled to the ion guide, the fragmentation or reaction cell and the mass analyzer, wherein the one or more power supplies are configured to:

supply a radio-frequency (RF) confining voltage to the stack of plate electrodes, a phase difference of the RF confining voltage being 180 degrees between each pair of adjacent plate electrodes;

supply an auxiliary RF voltage waveform to all plate electrodes of a section, each of a phase, amplitude and frequency of the provided auxiliary RF voltage being identical among all electrodes of the section; and supply a DC potential difference between the section to which the auxiliary RF voltage is provided and a second section that is adjacent thereto.

17. A mass spectrometer system as recited in claim 16, further comprising:

(vii) an electronic controller or computer processor comprising machine-readable program instructions operable to cause the one or more power supplies to vary one or both of an amplitude of the auxiliary RF voltage waveform and the variable DC potential difference such that ions are prevented from exiting the section to which the auxiliary RF voltage is supplied.

18. A mass spectrometer system as recited in claim 17, wherein the second section is disposed downstream from the section to which the auxiliary RF voltage is supplied and wherein the electronic controller or computer processor further comprises machine-readable program instructions operable to further cause the one or more power supplies to vary one or both of the amplitude of the auxiliary RF voltage waveform and the variable DC potential difference such that ion species are released from the section to which the auxiliary RF voltage is supplied and provided to the second section in accordance with their respective m/z values.

19. A mass spectrometer system comprising:

(i) an ionization source;

(ii) a mass filter apparatus configured to receive ions from the ionization source;

(iii) a fragmentation or reaction cell configured to receive ions filtered according to mass-to-charge ratio (m/z) by the mass filter and to trap and/or fragment or react the received ions so as to thereby generate product ions;

(iv) a mass analyzer configured to receive, mass analyze and detect the product ions;

(v) an ion guide configured to receive the filtered ions from the mass filter and to transmit the filtered ions to the fragmentation or reaction cell, the ion guide comprising:

an entrance end and an ion exit end;

an axis extending between the ion entrance and exit ends; and a sequence of sections disposed along the axis from the entrance lens to the exit lens, each section comprising:

a respective plurality of rod electrode segments, each rod electrode segment disposed about and parallel to the axis;

(vi) one or more power supplies electrically coupled to the ion guide, the fragmentation or reaction cell and the mass analyzer, wherein the one or more power supplies are configured to:

supply a radio-frequency (RF) confining voltage to the rod electrode segments;

supply an auxiliary RF voltage waveform to all rod electrode segments of a section, wherein a phase, amplitude and frequency of the provided auxiliary RF voltage is identical among all rod electrode segments of the section; and supply a DC potential difference between the section to which the auxiliary RF voltage is provided and a second section that is adjacent thereto.

20. A mass spectrometer system as recited in claim 19, further comprising:

(vii) an electronic controller or computer processor comprising machine-readable program instructions operable to cause the one or more power supplies to vary one or both of an amplitude of the auxiliary RF voltage waveform and the variable DC potential difference such that ions are prevented from exiting the section to which the auxiliary RF voltage is supplied.

21. A mass spectrometer system as recited in claim 20, wherein the electronic controller or computer processor further comprises machine-readable program instructions operable to further cause the one or more power supplies to vary one or both of the amplitude of the auxiliary RF voltage waveform and the variable DC potential difference such that ion species are released from the section to which the auxiliary RF voltage is supplied and provided to the second section in accordance with their respective m/z values.

* * * * *